US008287661B2

(12) United States Patent
Ishii et al.

(10) Patent No.: US 8,287,661 B2
(45) Date of Patent: Oct. 16, 2012

(54) METHOD FOR PRODUCING R-T-B SINTERED MAGNET

(75) Inventors: Rintaro Ishii, Mishima-gun (JP); Futoshi Kuniyoshi, Mishima-gun (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 13/143,566

(22) PCT Filed: Jan. 14, 2010

(86) PCT No.: PCT/JP2010/000178
§ 371 (c)(1),
(2), (4) Date: Jul. 7, 2011

(87) PCT Pub. No.: WO2010/082492
PCT Pub. Date: Jul. 22, 2010

(65) Prior Publication Data

US 2011/0262297 A1 Oct. 27, 2011

(30) Foreign Application Priority Data

Jan. 16, 2009 (JP) ..... 2009-007305
Mar. 27, 2009 (JP) ..... 2009-078230
Dec. 7, 2009 (JP) ..... 2009-277240

(51) Int. Cl.
*H01F 1/047* (2006.01)

(52) U.S. Cl. ..... 148/101; 148/103; 148/302; 419/12

(58) Field of Classification Search ..... None
See application file for complete search history.

(56) References Cited

U.S. PATENT DOCUMENTS 5,930,582 A * 7/1999 Ito et al. ..... 419/32
6,444,048 B1 * 9/2002 Hasegawa et al. ..... 148/101
6,468,365 B1 10/2002 Uchida et al.
7,192,493 B2 * 3/2007 Nishizawa et al. ..... 148/302
7,201,810 B2 * 4/2007 Morimoto et al. ..... 148/302
2006/0231165 A1 * 10/2006 Kato et al. ..... 148/302
(Continued)

FOREIGN PATENT DOCUMENTS

JP 06-096928 A 4/1994
(Continued)

OTHER PUBLICATIONS

Machine Translation of Japanese Patent Document No. 2009-032742A, Feb. 12, 2009.*
(Continued)

*Primary Examiner* — John Sheehan
(74) *Attorney, Agent, or Firm* — Keating & Bennett, LLP

(57) ABSTRACT

A method for producing a sintered R-T-B based magnet includes the steps of: providing R-T-B based alloy powders A and B so that the R-T-B based alloy powder B has a particle size D50 that is smaller by at least 1.0 μm than that of the R-T-B based alloy powder A and that there is a difference ΔRH of at least 4 mass % between the higher content of a heavy rare-earth element RH in the R-T-B based alloy powder B and the lower content of the heavy rare-earth element RH in the R-T-B based alloy powder A; mixing these two R-T-B based alloy powders A and B together; compacting the mixed R-T-B based alloy powder to obtain a compact with a predetermined shape; and sintering the compact.

6 Claims, 5 Drawing Sheets

U.S. PATENT DOCUMENTS

| | | | | |
|---|---|---|---|---|
| 2006/0272450 | A1* | 12/2006 | Odaka et al. | 75/352 |
| 2009/0019969 | A1 | 1/2009 | Kato et al. | |

FOREIGN PATENT DOCUMENTS

| | | | |
|---|---|---|---|
| JP | 2006-186216 | A | 7/2006 |
| JP | 2009-010305 | A | 1/2009 |
| JP | 2009-032742 | A | 2/2009 |

OTHER PUBLICATIONS

Official Communication issued in International Patent Application No. PCT/JP2010/000178, mailed on Apr. 6, 2010.

English translation of Official Communication issued in corresponding International Application PCT/JP2010/000178, mailed on Aug. 25, 2011.

* cited by examiner

METHOD FOR PRODUCING R-T-B SINTERED MAGNET

TECHNICAL FIELD

The present invention relates to a method for producing a sintered R-T-B based magnet with coercivity and remanence that are high enough to use it in motors, among other things.

BACKGROUND ART

Sintered R-T-B based magnets (where R is at least one of the rare-earth elements, T is Fe with or without Co, and B is boron) are currently used extensively in rotating motors, linear motors, voice coil motors (VCMs) and various other rotating machines. In this description, the "rare-earth elements" refer to a total of 17 elements consisting of Sc (scandium), Y (yttrium) and lanthanoids.

Sintered R-T-B based magnets certainly have great remanence but their relative Curie temperature is so low that irreversible flux loss will occur easily, which is one of the old drawbacks of the sintered R-T-B based magnets.

If a sintered R-T-B based magnet is used in a motor, that magnet will not only be exposed to a great demagnetization field but also come to have its temperature raised by the heat generated by a coil. That is why to prevent the sintered R-T-B based magnet from causing such irreversible flux loss, the coercivity thereof should be increased.

According to conventional technologies, at least one of Dy and Tb, which are heavy rare-earth elements RH, is added a lot to a sintered R-T-B based magnet in order to minimize such irreversible flux loss. If a lot of heavy rare-earth element RH is added, however, the coercivity will certainly increase but the remanence will rather decrease, which is a problem. The reason is that if the heavy rare-earth element RH is added, then Nd or Pr that will produce high remanence will be replaced as its R component in an $R_2T_{14}B$ compound, which is the main phase of the sintered R-T-B based magnet, with Dy or Tb that will produce only low remanence.

On top of that, since Dy and Tb are very rare and expensive elements, it is not a cost-effective measure, either, to add a lot of Dy or Tb.

Thus, to overcome such problems, various techniques for increasing the coercivity with the amount of the heavy rare-earth element RH added minimized have been proposed so far. For example, it was proposed that the heavy rare-earth element RH be added in a high concentration only to a shell portion of a main phase crystal grain, where the local anti-magnetic field has so great strength as to start magnetization reversal. And a two-alloy process was tentatively used as a specific method to take for that purpose.

Specifically, according to the technique disclosed in Patent Document No. 1, two different kinds of R-T-B based alloy powders are mixed together. In this case, those two alloy powders may have the same R mole fraction and the other main components thereof may also have the same composition except the mole fractions of Dy, Nd and other R elements only. Or those two alloy powders may have the same R mole fraction and the other main components thereof may also have the same composition except the mole fractions of Dy and Nd and other R elements and Fe that has been partially replaced with a refractory metal such as Nb. In this manner, an R-T-B based sintered permanent magnet, of which the main phase crystal grains have a characteristic Dy concentration distribution and which has a main phase crystal grain size distribution that contributes to achieving high Br and high $(BH)_{max}$, can be obtained with good stability.

Patent Document No. 2 discloses a technique for making a sintered R-T-B based magnet in which three $R_2T_{14}B$ phases including a heavy rare-earth element RH in high, low and intermediate concentrations, respectively, are present in mixture in a single crystal grain by providing two $R_2T_{14}B$ based alloys including, as rare-earth elements R, light and heavy rare-earth elements RL and RH in mutually different ratios, mixing those two alloys together, pulverizing the mixture, and then sintering the pulverized powder.

Patent Document No. 3 discloses a technique for making a sintered rare-earth magnet by mixing together a first component powder mainly composed of an intermetallic $Nd_2Fe_{14}B$ compound and a second component powder mainly composed of $R(Cu_{1-x}T_x)$ and/or $R(Cu_{1-x}T_x)_2$, compacting the mixture under a magnetic field, and then subjecting the compact to liquid crystal phase sintering.

Patent Document No. 4 discloses a technique for producing a rare-earth magnet by performing the steps of: mixing first and second magnetic powders together to obtain a mixed magnetic powder; compacting the mixed magnetic powder to obtain a green compact; and sintering the green compact. In this case, the first magnetic powder is made of a magnetic material including rare-earth elements, transition elements and boron (B), has a mean particle size of 10 μm or less, and includes Dy as one of the rare-earth elements. On the other hand, the second magnetic powder is made a magnetic material including rare-earth elements, transition elements and boron (B), has a second mean particle size that is also 10 μm or less but that is different from that of the first magnetic powder, and includes Dy in a second mole fraction that is different from the Dy mole fraction of the first magnetic powder.

And Patent Document No. 5 discloses a technique for making a sintered R-T-B based magnet, where the main phase crystal grains have a core-shell structure, which consists of a core portion and a shell portion that surrounds the core portion and in which the concentration of a heavy rare-earth element is lower by at least 10% in the core portion than in the surface region of the shell portion. In such a sintered R-T-B based magnet, the average of an L/r ratio, which is the ratio of the shortest distance L from the surface of the shell portion of a main phase crystal grain to its core portion to the equivalent circle diameter r of the main phase crystal grain 1, falls within the range of 0.03 to 0.40.

Citation List

Patent Literature

Patent Document No. 1: Japanese Patent Application Laid-Open Publication No. 2000-188213

Patent Document No. 2: Japanese Patent Application Laid-Open Publication No. 2002-356701

Patent Document No. 3: Japanese Patent Application Laid-Open Publication No. 6-96928

Patent Document No. 4: Japanese Patent Application Laid-Open Publication No. 2006-186216

Patent Document No. 5: PCT International Application Publication No. 2006/98204

SUMMARY OF INVENTION

Technical Problem

However, even if a sintered magnet was made by adopting any of the techniques disclosed in these Patent Documents Nos. 1 to 5, the resultant magnet could not have higher coercivity and higher remanence at the same time than a magnet that had been made of a single alloy with the same composition.

When the present inventors actually made a sintered magnet by adopting the technique disclosed in Patent Document No. 1 or 2 and observed it, we obtained the following results. Specifically, with such a technique adopted, a powder including a heavy rare-earth element RH in a relatively low concentration and a powder including the heavy rare-earth element RH in a relatively high concentration have almost no different particle size distributions. That is why the crystal grains will grow so that the R-T-B based alloy powder with the higher heavy rare-earth element RH concentration is introduced into the shell portion of the R-T-B based alloy powder with the lower heavy rare-earth element RH concentration. Nevertheless, in the resultant sintered magnet, there are a lot of main phase crystal grains 5, one half of which is a portion 3 where the heavy rare-earth element RH accounts for a low percentage of its rare-earth element R and the other half of which is a portion 4 where the heavy rare-earth element RH accounts for a high percentage of its rare-earth element R as shown in FIG. 2(*a*). In addition, there are also a number of main phase crystal grains 5, in which the portion 4 where the heavy rare-earth element RH accounts for a high percentage of its rare-earth element R is coated with the portion 3 where the heavy rare-earth element RH accounts for a low percentage of its rare-earth element R, as shown in FIG. 2(*b*).

On the other hand, according to the manufacturing process disclosed in Patent Document No. 3, a first component powder composed mainly of an intermetallic $Nd_2Fe_{14}B$ compound and a second component powder composed mainly of $R(Cu_{1-x}T_x)$ and/or $R(Cu_{1-x}T_x)_2$, which are two powders with quite different compositions, are mixed together and then the mixed powder is sintered. That is why the Kirkendall effect and other effects would often interfere with the densification during the sintering process. As a result, the density cannot be increased with the intended fine crystal grain size maintained, and eventually the magnetization will decrease due to such an insufficient density. Also, even if the density can be increased in one way or another, abnormal grain growth could occur and cause a significant decrease in coercivity, which is a serious problem, too.

According to Patent Document No. 4, if one of the first and second magnetic powders that has the larger mean particle size has the larger Dy mole fraction, the remanence should be further increased with expected coercivity values that would be achieved by the compositions of the respective magnetic powders maintained. However, even if the manufacturing process disclosed in Patent Document No. 4 is simply adopted, the sintered magnet will also have a number of main phase crystal grains 5, in which the portion 4 where the heavy rare-earth element RH accounts for a high percentage of its rare-earth element R is coated with the portion 3 where the heavy rare-earth element RH accounts for a low percentage of its rare-earth element R, as shown in FIG. 2(*b*). Consequently, it is difficult to make a magnet with high coercivity.

Also, according to Patent Document No. 5, the first and second alloys do not have different particle size distributions. That is why the resultant sintered magnet will include not just main phase crystal grains with the intended core-shell structure, in which the heavy rare-earth element has at least 10% lower concentration in its core portion than in the surface region of its shell portion but also a lot of main phase crystal grains 5, one half of which is a portion 3 where the heavy rare-earth element RH accounts for a low percentage of its rare-earth element R and the other half of which is a portion 4 where the heavy rare-earth element RH accounts for a high percentage of its rare-earth element R as shown in FIG. 2(*a*). In addition, there are also a number of main phase crystal grains 5, in which the portion 4 where the heavy rare-earth element RH accounts for a high percentage of its rare-earth element R is coated with the portion 3 where the heavy rare-earth element RH accounts for a low percentage of its rare-earth element R, as shown in FIG. 2(*b*). Consequently, it is also difficult to make a magnet with high coercivity.

It is therefore an object of the present invention to provide a sintered R-T-B based magnet having a structure in which a heavy rare-earth element RH is included in a higher concentration in a shell portion of a main phase crystal grain. By using two different kinds of R-T-B based alloy powders, which have R-T-B based alloy compositions including the heavy rare-earth element RH in mutually different concentrations and one of which includes the heavy rare-earth element RH in the higher concentration, and has the smaller powder particle size, than other, these two powders will behave quite differently during the sintering process, thereby realizing the intended sintered magnet structure in which the heavy rare-earth element RH is included in a higher concentration in the shell portion of the main phase crystal grain. As a result, a sintered R-T-B based magnet, of which the remanence $B_r$ has hardly decreased and yet the coercivity $H_{cJ}$ has increased significantly, can be obtained.

Solution to Problem

According to the present invention, when two material alloy powders with mutually different compositions, of which the heavy rare-earth element (RH) concentrations (which will be referred to herein as "RH concentrations") are different, are mixed and sintered, one of the two alloy powders that has the higher RH concentration has its powder particle size defined to be smaller than the other alloy powder's, thereby raising the surface energy. As a result, during the sintering process, the alloy powder with the higher RH concentration can be turned into liquid phase earlier than the alloy powder with the lower RH concentration that is kept in solid phase. That is to say, the liquid phase can have the higher RH concentration than the solid phase. Consequently, crystal grains will grow so that the R-T-B based alloy powder with the smaller particle size is introduced into the shell portion of the R-T-B based alloy powder with the larger particle size in the sintered structure as shown in FIG. 1. In this manner, a structure, in which a portion where the heavy rare-earth element RH accounts for a low percentage of its rare-earth element R is coated with a portion where the heavy rare-earth element RH accounts for a high percentage of its rare-earth element R (i.e., a structure in which the heavy rare-earth element RH is included in the higher concentration in part or all of the shell portion of the main phase) can be obtained.

A method for producing a sintered R-T-B based magnet according to the present invention includes the steps of: providing R-T-B based alloy powders A and B, wherein the powder A includes 27.3 mass % to 31.2 mass % of R (which is at least one of the rare-earth elements), 0.92 mass % to 1.15 mass % of B, and T as the balance (where T is either Fe alone or Fe and Co and where Co accounts for at most 20 mass % of T if T includes Fe and Co) and wherein the powder B includes 27.3 mass % to 36.0 mass % of R (which is at least one of the rare-earth elements), 0.92 mass % to 1.15 mass % of B, and T as the balance (where T is either Fe alone or Fe and Co and where Co accounts for at most 20 mass % of T if T includes Fe and Co); mixing these two R-T-B based alloy powders A and B together; compacting the mixed R-T-B based alloy powder to obtain a compact with a predetermined shape; and sintering the compact. R included in the R-T-B based alloy powder B includes 4 mass % to 36 mass % of heavy rare-earth element RH, which is at least one of Dy and Tb. The content of the heavy rare-earth element RH in the R-T-B based alloy powder B is larger by at least 4 mass % than the content of the heavy rare-earth element RH in the R-T-B based alloy powder A. The particle size D50 of the R-T-B based alloy powder B is smaller by at least 1.0 μm than the particle size D50 of the R-T-B based alloy powder A.

In one preferred embodiment of the present invention, in the step of mixing, the R-T-B based alloy powder A has a particle size D50 of 3 to 5 μm.

In another preferred embodiment of the present invention, in the step of mixing, the R-T-B based alloy powder B has a particle size D50 of 1.5 to 3 μm.

In yet another preferred embodiment of the present invention, in the step of mixing the R-T-B based alloy powders A and B together, the ratio of the mass of the R-T-B based alloy powder A to the mass of the R-T-B based alloy powder B is controlled to fall within the range of 60:40 to 90:10.

Advantageous Effects of Invention

The present invention provides a sintered R-T-B based magnet, which has a structure where a heavy rare-earth element RH is included in a higher concentration in the shell portion of its main phase and which has a hardly decreased remanence $B_r$ and a significantly increased coercivity $H_{cJ}$.

DESCRIPTION OF EMBODIMENTS

Composition

Figure 1:
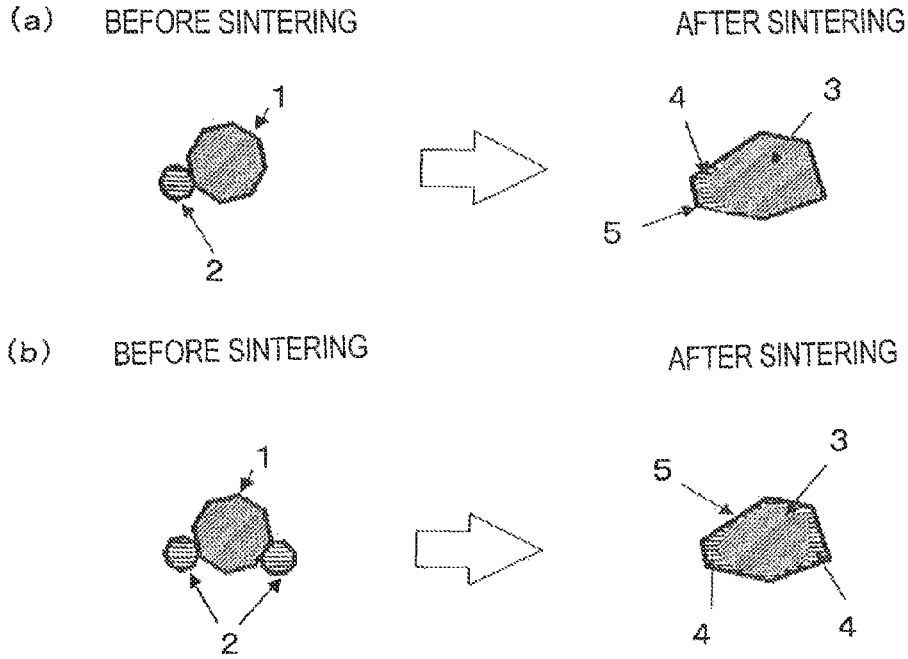
FIGS. 1(*a*) and 1(*b*) are schematic representations illustrating a powder yet to be sintered and a sintered crystal grain, which are obtained by a sintered R-T-B based magnet manufacturing process according to the present invention.

According to the present invention, a sintered R-T-B based magnet is made of a mixture of R-T-B based alloy powders A and B.

In the composition of the R-T-B based alloy A, R is at least one of the rare-earth elements and accounts for 27.3 mass % to 31.2 mass % of the entire magnet alloy. In this description, the proportion represented in mass % is the ratio to the mass of the entire magnet alloy as a matter of principle. The rare-earth element R included in the R-T-B based alloy A may be one or both of Dy and Tb, which are heavy rare-earth elements RH to use selectively depending on the necessity. This R mole fraction is preferred for the following reasons. Specifically, if the R mole fraction were less than 27.3 mass %, then it would be difficult to sinter the compact as intended. On top of that, a soft magnetic phase could be produced to decrease the coercivity of the sintered R-T-B based magnet. Nevertheless, if the R mole fraction were more than 31.2 mass %, then the sintered R-T-B based magnet would have decreased magnetization.

B included should fall within the range of 0.92 mass % to 1.15 mass %. This range is preferred for the following reason. Specifically, if the B mole fraction were less than 0.92 mass %, a soft magnetic phase could be produced to decrease the coercivity of the sintered R-T-B based magnet. However, if the B mole fraction were greater than 1.15 mass %, then the sintered R-T-B based magnet would have decreased magnetization.

And T is the balance of the alloy A and is either Fe alone or a combination of Fe and Co. It is preferred that if T includes Co, then Co account for at most 20 mass % of T. This is because if Co accounted for more than 20 mass % of the entire magnet, the sintered R-T-B based magnet would have decreased magnetization.

The R-T-B based alloy A may include a very small amount of additive element M to achieve known effects. The content of M is in the range of 0.02 mass % to 0.5 mass %. In this case, M is one, two or more elements selected from the group consisting of Al, Cu, Ti, V, Cr, Mn, Ni, Zn, Ga, Zr, Nb, Mo, Ag, In, Sn, Hf, Ta, W, Au, Pb and Bi. By adding such a very small amount of additive element M in a predetermined percentage, the magnetic properties including remanence and coercivity, the mechanical properties such as strength and the weather resistance can all be improved.

On the other hand, in the composition of the R-T-B based alloy B, R is at least one of the rare-earth elements including Y, and its mole fraction falls within the range of 27.3 mass % to 36.0 mass %. It should be noted that R in the R-T-B based alloy always includes a heavy rare-earth element RH, which is Dy and/or Tb. The RH concentration, i.e., the combined mole fraction of Dy+Tb, accounts for 4 mass % to 36 mass % of the entire magnet alloy. This R mole fraction is preferred for the following reasons. Specifically, if the R mole fraction were less than 27.3 mass %, it would be difficult to produce a liquid phase during the sintering process. However, if the R mole fraction were more than 36 mass %, then the sintered R-T-B based magnet would have decreased magnetization. And if the combined mole fraction of Dy and Tb were less than 4 mass %, the sintered magnet would not have the intended structure.

The other components of the R-T-B based alloy B, including B, T and very small amounts of additive elements M, may be identical with those of the R-T-B based alloy A and their mole fractions may fall within the same ranges as those of the R-T-B based alloy A. However, their mole fractions in the alloy B do not have to the same as those of the alloy A.

Comparing the respective heavy rare-earth element RH concentrations (in mass %) of the two R-T-B based alloys A and B to each other, it can be seen that the heavy rare-earth element RH is included more in the alloy B than in the alloy A, and their difference ΔRH is supposed to be 4 mass % or more. By setting ΔRH to be 4 mass % or more, the sintered magnet can have a structure in which the heavy rare-earth element is included in a higher concentration around the shell portion of each main phase crystal grain. ΔRH is preferably at least equal to 4 mass % because otherwise the heavy rare-earth element RH included around the shell portion of each main phase would have too low a concentration to achieve intended excellent magnetic properties. Nevertheless, if ΔRH were more than 16 mass %, other unwanted phases including the heavy rare-earth elements RH in high concentrations could be produced a lot depending on the manufacturing process condition in addition to theft structure in which the heavy rare-earth element RH is included in a higher concentration around the shell portion of the main phase. For these reasons, it is preferred that ΔRH fall within that range of 4 mass % to 16 mass %, no more and no less.

Powder Particle Size

According to the present invention, the two R-T-B based alloys A and B are pulverized, thereby obtaining powders that have respectively predetermined powder particle sizes. The particle size D50 of the R-T-B based alloy powder A, which has the smaller heavy rare-earth element RH concentration, is preferably greater by at least 1.0 μm than the particle size D50 of the R-T-B based alloy powder B. The particle size difference should be at least equal to 1.0 μm because otherwise, the behaviors of these two powders could not be controlled, during the sintering process and the sintered magnet could not have the intended structure in which the heavy rare-earth element is included in a higher concentration around the shell portion of each main phase crystal grain. It should be noted that D50 represents a powder particle size measured by dry jet dispersion laser diffraction analysis. More specifically, D50 is the diameter of particles, of which the cumulative volume accounts for 50% of the overall powder when the particles are arranged in the ascending order of their particle sizes.

Material Alloy

The material alloy can be obtained by some ordinary process such as an ingot casting process, a strip casting process or a direct reduction process.

Among other things, the strip casting process can be used particularly effectively according to the present invention because the strip casting process would leave almost no αFe phase in the metal structure and can be used to make an alloy at a reduced cost without using any casting mold. Also, according to the present invention, to achieve a smaller particle size by pulverization in a preferred embodiment than in the prior art, the average R-rich phase interval is preferably 5 μm or less in the strip casting process. This is because if the R-rich phase interval exceeded 5 μm, an excessive load would be imposed on the fine pulverization process, in which the amounts of impurities contained would increase significantly.

To set the average R-rich phase interval to be 5 μm or less in the strip casting process, the thickness of the cast flakes can be reduced by decreasing the melt feeding rate, the melt quenching rate may be increased by decreasing the surface roughness of the chill roller and increasing the degree of close contact between the melt and the chill roller, and/or the chill roller may be made of Cu or any other material with good thermal conductivity. The average R-rich phase interval can be reduced to 5 μm or less by adopting either only one of these methods or two or more of them in combination.

Also, the R-T-B based alloys A and B may have two different alloy structures. Specifically, if the average R-rich phase interval of the R-T-B based alloy B is set to be smaller than that of the R-T-B based alloy A, the powders obtained by finely pulverizing these two powders can easily have a particle size difference of 1 μm or more during the fine pulverization process.

It should be noted that although these two R-T-B based alloys A and B are supposed to be mixed together according to the present invention, a third alloy with a different composition (which could even be a single metal) could be added as well.

Pulverization

As an example of a manufacturing process for producing the magnet of the present invention, a process in which pulverization is carried out in two stages (which will be referred to herein as "coarse pulverization" and "fine pulverization", respectively) will be described. However, according to the present invention, not just the manufacturing process to be described below but also any other manufacturing process may be adopted as well.

The material alloy is preferably coarsely pulverized by hydrogen decrepitation process, which is a process for producing very small cracks in the alloy by taking advantage of its decrepitation and volume expansion due to hydrogen occlusion and thereby pulverizing the alloy. In the alloy of the present invention, the cracks are produced due to a difference in the rate of occluding hydrogen between the main phase and the R-rich phase (i.e., a difference in their volume variation). That is why according to the hydrogen decrepitation process, the main phase is more likely to crack on the grain boundary.

In a hydrogen decrepitation process, normally the material alloy is exposed to pressurized hydrogen for a certain period of time. In some cases, the alloy may then be heated to a raised temperature to release excessive hydrogen. The coarse powder obtained by such a hydrogen decrepitation process has a huge number of internal cracks and a significantly increased specific surface. That is why the coarse powder is so active that a lot more oxygen would be absorbed when the powder is handled in the air. For that reason, the powder is preferably handled in an inert gas such as nitrogen or Ar gas. On top of that, as nitrification reaction could also occur at high temperatures, it is preferred that the coarse powder be handled in an Ar atmosphere if some increase in manufacturing cost could be afforded.

In the pulverization process, the content of inevitably contained oxygen, in particular, needs to be controlled. This is because oxygen will affect the magnetic properties and the manufacturing process of a magnet more seriously than any other one of various inevitable impurities. Once the R-T-B based alloy A or B or their mixture has been pulverized, oxygen included in it can no longer be removed in any subsequent process step. That is why the completed magnet will have at least as high an oxygen content as its fine powder in that case.

The oxygen content is preferably 0.25 mass % or less. This is because if the oxygen content were more than 0.25 mass %, then the heavy rare-earth element RH included a lot in liquid phase components during the sintering process would be bonded to oxygen more easily than any other rare-earth element due to its great affinity for oxygen and its oxide would remain on the grain boundaries even after the magnet is completed. In that case, the concentration of the heavy rare-earth element RH that should be high in the shell portion of the main phase could be lower than expected, the target structure could not be obtained, and the coercivity could not be high anymore. The oxygen content is more preferably 0.2 mass % or less.

As the fine pulverization process, dry pulverization may be carried out using a jet pulverizer. In that case, nitrogen gas is usually used as a pulverization gas for this type of magnet. According to the present invention, however, a rare gas such as Ar gas is preferably used to minimize the content of nitrogen in the composition of the magnet. If a He gas is used, then considerably great pulverization energy can be produced. As a result, a fine powder, which can be used effectively in the present invention, can be obtained easily. However, as the He gas is expensive, such a gas is preferably circulated with a compressor introduced into the pulverizer. Hydrogen gas could also achieve a similar effect but is not preferred from an industrial point of view because the hydrogen gas might explode when mixed with oxygen gas.

The powder can be pulverized to a smaller particle size by performing a dry pulverization process using a gas that has great pulverization ability such as He gas, for example. Alternatively, the particle size can also be reduced by increasing the pressure or the temperature of the pulverization gas. Any of these methods can be adopted appropriately depending on the necessity.

Alternatively, a wet pulverization process may also be performed. Specifically, either a ball mill or an attritor may be used, for example. In that case, the pulverization medium and solvent and the atmosphere need to be selected so as to avoid absorbing oxygen, carbon and other impurities in more than predetermined amounts. On the other hand, with a beads mill for stirring up the given powder at high speeds using balls with a very small diameter, the powder can be pulverized finely in a short time and the influence of impurities can be minimized. That is why a beads mill is preferably used to obtain a fine powder for use in the present invention.

Furthermore, if the material alloy is pulverized in multiple stages (e.g., coarsely pulverized first by a dry process using a jet pulverizer and then finely pulverized by a wet process using a beads mill), then the alloy can be pulverized efficiently in a short time and the amounts of impurities contained in the fine powder can be minimized.

The solvent for use in the wet pulverization process is selected with its reactivity to the material alloy, its ability to reduce oxidation, and its removability before the sintering process taken into consideration. For example, an organic solvent (e.g., a saturated hydrocarbon such as isoparaffin, among other things) is preferably used.

According to the present invention, the R-T-B based alloys A and B are pulverized separately from each other to obtain R-T-B based alloy powders A and B, respectively. If coarsely pulverized R-T-B based alloy powders A and B are mixed together and then their mixture is finely pulverized, their D50 particle sizes may be different from each other by about 0.1 to 0.2 μm. However, the D50 particle size difference between these R-T-B based alloy powders A and B cannot be equal to or greater than 1.0 μm. If the D50 particle size difference between the R-T-B based alloy powders A and B should be increased to 1.0 μm or more, the fine pulverization process should be performed on the R-T-B based alloy powders A and B under mutually different conditions.

The fine pulverization process is preferably carried out so that the pulverized R-T-B based alloy powder A, which is one of the two fine powders obtained by the fine pulverization process, satisfies D50≦6 μm. The reason is that if the D50 particle size of the R-T-B based alloy powder A were more than 6 μm, then the maximum crystal grain size in the sintered R-T-B based magnet tends to have an equivalent circle diameter of 25 μm or more. In that case, as crystal grains grow, the coercivity will decrease. In this description, the "equivalent circle diameter" refers to the diameter of a circle, of which the area is equal to that of a crystal grain in an indefinite shape to be observed in a crystal structure. And the equivalent circle diameter can be obtained easily by performing an image analysis on a photograph representing a cross-sectional structure of a magnet. Meanwhile, the "average crystal grain size" to be described later refers to the diameter of a circle, of which the area is equal to "the total area of main phases divided by the number of crystal grains" and which can be obtained on a photograph representing its cross-sectional structure.

On the other hand, the R-T-B based alloy powder B is pulverized so that the pulverized R-T-B based alloy powder B has a smaller particle size than the R-T-B based alloy powder A and satisfies D50≦3.5 μm.

In this process step, the R-T-B based alloy powder A is preferably pulverized so as to have a D50 particle size of 3 μm to 5 μm, while the R-T-B based alloy powder B is preferably pulverized so as to have a D50 particle size of 1.5 μm to 3.5 μm. These sizes are preferred because if the difference in D50 particle size between the R-T-B based alloy powders A and B were less than 1.0 μm, the concentration of the heavy rare-earth element around the shell portion of each main phase crystal grain would not be high enough to achieve excellent magnetic properties.

Mixing

According to this preferred embodiment, the R-T-B based alloy powders A and B, which have been obtained by the pulverization process described above, are mixed together in a rocking mixer with an appropriate amount of lubricant added thereto, thereby coating the surface of the alloy powder particles with the lubricant. In this process step, the R-T-B based alloy powders A and B are mixed together so that the ratio of the mass of the R-T-B based alloy powder A to that of the R-T-B based alloy powder B is in the range of 60:40 to 90:10.

Compaction

A compaction process to make the magnet of the present invention may be a known one. For example, the fine powder described above may be pressed and compacted with a die under a magnetic field. To minimize the amounts of oxygen, carbon and other impurities absorbed, the use of the lubricant is preferably minimized. But when a lubricant needs to be used, a highly volatile lubricant, which can be removed either during the sintering process or even before that, may be selectively used from known ones.

To minimize oxidation, it is preferred that the fine powder and a solvent be mixed together to make a slurry and then the slurry be compacted under a magnetic field. In that case, considering the volatility of the solvent, a hydrocarbon with a low molecular weight that can be vaporized almost completely in a vacuum at 250° C. or less may be selected for the next sintering process. Among other things, a saturated hydrocarbon such as isoparaffin is preferred. Also, the slurry may also be made by collecting the fine powder directly in the solvent.

The pressure to be applied during the compaction process is not particularly limited. However, the pressure should be at least 9.8 MPa and preferably 19.6 MPa or more, and the upper limit thereof is 245 MPa at most, and preferably 196 MPa. In any case, the compacting pressure is set so that the resultant compact has a green density of approximately 3.5 $Mg/cm^3$ to 4.5 $Mg/cm^3$. The magnetic field applied has a strength of 0.8 MA/m to 1.5 MA/m, for example.

Sintering

The sintering process is supposed to be carried out within either a vacuum or an inert gas atmosphere, of which the pressure is lower than the atmospheric pressure and where the inert gas refers to Ar and/or He gas(es).

Such an inert gas atmosphere, of which the pressure is lower than the atmospheric pressure, is preferably maintained by evacuating the sintering furnace with a vacuum pump and introducing the inert gas into the furnace. In that case, either evacuation or introduction of the inert gas may be performed intermittently. Or both the evacuation and the introduction of the inert gas may be carried out intermittently.

To remove sufficiently the lubricant and solvent that have been used in the fine pulverization process and the compaction process, preferably it is not until a binder removal process is done that the sintering process is started. The binder removal process may be carried out by keeping the compact heated to a temperature of 300° C. or less for 30 minutes to 8 hours within either a vacuum or an inert gas atmosphere, of which the pressure is lower than the atmospheric pressure. The binder removal process could be performed independently of the sintering process but the binder removal process and the sintering process are preferably performed continuously to increase the efficiency of the process and reduce the oxidation as much as possible. The binder removal process is preferably carried out within an inert gas atmosphere, of which the pressure is lower than the atmospheric pressure, in order to get the binder removal process done as efficiently as possible. Optionally, to get the binder removal process done even more efficiently, the heat treatment may be carried out within a hydrogen atmosphere.

In the sintering process, the compact is seen to release a gas while having its temperature raised. The gas released is mostly the hydrogen gas that has been introduced during the hydrogen decrepitation process. It is not until the hydrogen gas is released that the liquid phase is produced. That is why to release the hydrogen gas completely, the compact is preferably kept heated to a temperature of 700° C. to 850° C. for 30 minutes to 4 hours.

The compact is supposed to be sintered at a temperature of 860° C. to 1100° C. This temperature range is preferred for the following reasons. Specifically, if the sintering process temperature were lower than 860° C., then the sintered density achieved would be insufficient. However, if the sintering process temperature were higher than 1100° C., the component of the R-T-B based alloy A would also be included in the liquid phase, the concentration of the heavy rare-earth element RH in the liquid phase would decrease, and the sintered magnet would not have a sufficiently thick layer with an increased RH concentration in the shell portion of its main phase. On top of that, an abnormal grain growth would advance so easily that the resultant magnet would have decreased coercivity. A sintered structure, of which the maximum crystal grain size is represented by an equivalent circle diameter of 25 μm or less, would cause no such abnormal grain growth.

In the sintered structure of the magnet of the present invention, its main phases preferably have a small and uniform crystal grain size to achieve high coercivity, even though the crystal grain size is not particularly limited. Specifically, its crystal grain size is preferably represented by an equivalent circle diameter of 25 μm or less, more preferably 15 μm or less. To get such a sintered structure, of which the crystal grain size is represented by an equivalent circle diameter of 15 μm or less, the sintering process temperature is preferably set to be 1050° C. or less.

Furthermore, to obtain a sintered structure, in which main phase crystal grains with a size of 8 μm or less account for 80% or more of the overall area of the main phase crystal grains, the sintering process temperature is preferably 1020° C. or less. The sintering process temperature should also be low in order to prevent the heavy rare-earth element RH from diffusing deep enough to reach the core portion of the main phase. That is why the sintering process temperature is more preferably 1000° C. or less. Supposing a combination of two alloys with the same composition is used, the bigger the difference in particle size and the smaller the amounts of impurities included, the lower the sintering process temperature and the less easily the heavy rare-earth element RH can diffuse and reach the core of the main phase.

The sintering process temperature preferably falls within the preferred range for 2 to 16 hours. The reasons are as follows. Specifically, if the temperature stayed within that preferred range for less than two hours, the compact would not have its density increased sufficiently through the process, and therefore, a sufficiently high sintered density could not be achieved or the magnet would have decreased remanence. However, if the sintering process temperature stayed within that range for more than 16 hours, the density and the magnetic properties would vary a little. But chances of producing a crystal structure with an average crystal grain size of more than 12 μm in the sintered structure would increase. And if such a crystal structure were produced, the coercivity would decrease. However, if the sintering process is performed at 1000° C. or less, then the sintering process could be continued for an even longer time, e.g., 48 hours or less. But if the sintering process is performed at 1000° C. or less, then the sintering process may ordinarily be performed for 4 to 16 hours.

It should be noted, however, that in the sintering process, the sintering process temperature does not have to be maintained at a certain temperature falling within that preferred range for that preferred period of time. In other words, the sintering process temperature may be varied within that range. For example, the sintering process temperature could be maintained at 1000° C. for the first two hours and then maintained at 940° C. for the next four hours. Alternatively, the sintering process temperature may even be gradually lowered from 1000° C. to 860° C. in eight hours, instead of being maintained at a particular temperature.

In the sintering process of this preferred embodiment, the two different kinds of alloy powders will behave so differently through the process that crystal grains will grow so that the R-T-B based alloy powder with the smaller particle size and the greater heavy rare-earth element RH concentration is introduced into the surface region of the R-T-B based alloy powder with the larger particle size and the smaller heavy rare-earth element RH concentration. As a result, the sintered magnet can have a structure in which the heavy rare-earth element RH is included in a higher concentration in the shell portion of the main phase. That is to say, a high-performance sintered R-T-B based magnet, including the heavy rare-earth element RH in such a high concentration in the shell portion of its main phase, can be obtained as shown in FIGS. 1(*a*) and 1(*b*).

To obtain the structure of the present invention, it is necessary to prevent the heavy rare-earth element RH from diffusing too deep in the sintering process to keep a significant concentration difference in the main phase. For that purpose, the sintering process temperature is preferably as low as possible. Specifically, the sintering process temperature is at most 1050° C. and is preferably set to be 1030° C., and even more preferably 1020° C.

The sintering process condition is preferably defined so that once a liquid phase has been produced, the process temperature to maintain can be somewhat lowered. For example, if the sintering process is started at a temperature of 1020° C., the sintering process temperature may be lowered to 960° C. once a liquid phase has been produced in several ten minutes to several hours in the compact of the R-T-B based alloy, and then the sintering process may be continued until a true density is reached in another several ten minutes to several hours.

Heat Treatment

After the sintering process is finished, the sintered compact is once cooled to 300° C. or less. After that, the sintered compact is thermally treated within the range of 400° C. to its sintering process temperature to have its coercivity increased. This heat treatment may be either carried out continuously at the same temperature or performed in multiple steps with the temperature changed. Particularly, according to the present invention, by defining the amount of Cu added to fall within a predetermined range, the coercivity can be increased even more significantly by conducting this heat treatment process. For example, the heat treatment process may be carried out in the three steps of: keeping the sintered compact heated to 1000° C. for an hour and cooling it rapidly; keeping the compact heated to 800° C. for an hour and cooling it rapidly; and keeping the compact heated to 500° C. for an hour and then cooling it rapidly. In some cases, the coercivity may increase by keeping the compact heated to the heat treatment temperature and then cooling it slowly. Since the magnetization does not usually vary during the heat treatment after the sintering process, appropriate conditions can be set to increase the coercivity according to the composition, size, or shape of the magnet.

Machining

The sintered R-T-B based magnet of the present invention may be subjected to some ordinary kind of machining such as cutting or grinding to obtain a desired shape or size.

Surface Treatment

The sintered R-T-B based magnet of the present invention is preferably subjected to some kind of surface coating treatment for anti-corrosion purposes. Examples of preferred surface coating treatments include Ni plating, Sn plating, Zn plating, vapor deposition of an Al film or an Al-based alloy film, and resin coating.

Magnetization

The sintered R-T-B based magnet of the present invention can be magnetized by an ordinary magnetization method (including application of a pulse magnetic field and application of a static magnetic field). In order to handle the magnet material as easily as possible, the magnet material is usually magnetized by such a method after the magnet material has been arranged to form a magnetic circuit. Naturally, however, the magnet can be magnetized by itself.

EXAMPLES

Example 1

An alloy with a target composition was obtained by mixing together Nd with a purity of 99.5 mass % or more, Tb and Dy with a purity of 99.9 mass % or more, electrolytic iron and low-carbon ferroboron as main ingredients, along with other target additive elements that were added as either pure metals or alloys with Fe, and the mixture was melted. The melt thus obtained was cast by strip casting process, thereby obtaining a plate alloy with a thickness of 0.3 to 0.4 mm.

Next, that alloy was decrepitated with hydrogen in a pressurized hydrogen atmosphere, heated to 600° C. within a vacuum, and then cooled to obtain a coarse powder. To this coarse powder, further added was 0.05 mass % of zinc stearate. And the powder and the lubricant were mixed together.

Next, the mixture was subjected to a dry pulverization process using a jet pulverizer (i.e., jet mill) within a nitrogen gas jet, thereby obtaining an R-T-B based alloy powder A with any of the particle sizes D50 shown in the following Table 1. In this process step, the concentration of oxygen in the pulverization gas was controlled to 50 ppm or less. This particle size D50 was obtained by dry jet dispersion laser diffraction analysis.

Meanwhile, a pulverization process was carried out in the same way as the one for making the R-T-B based alloy powder A except that the jet in the jet pulverizer was replaced with either He or high-pressure nitrogen, thereby obtaining an R-T-B based alloy powder B having the target composition and any of the D50 particle sizes shown in the following Table 1.

The respective compositions and D50 particle sizes of the R-T-B based alloy powders A and B thus obtained are shown in unit mass % and μm in the following Table 1, too. Their compositions were analyzed by inductively coupled plasma atomic emission spectroscopy (ICP-AES). The contents of oxygen, nitrogen and carbon shown in the following Table 1 were obtained as analyzed values by a gas analyzer and are shown in mass %.

TABLE 1

| | R-T-B based alloy powder A | | | | | | | | | | | | R-T-B based alloy powder B | | |
|---|---|---|---|---|---|---|---|---|---|---|---|---|---|---|---|
| | composition (mass %) | | | | | | | | | | | D50 | composition (mass %) | | |
| No | Fe | Nd | Dy | B | Co | Al | Cu | Ga | O | N | C | (μm) | Fe | Nd | Dy |
| 1 | Bal | 29.5 | 0.0 | 0.95 | 0.9 | 0.15 | 0.1 | 0.1 | 0.190 | 0.020 | 0.100 | 4.8 | Bal | 19.5 | 10.0 |
| 2 | Bal | 29.5 | 0.0 | 0.95 | 0.9 | 0.15 | 0.1 | 0.1 | 0.200 | 0.020 | 0.100 | 4.8 | Bal | 19.5 | 10.0 |
| 3 | Bal | 29.5 | 0.0 | 0.95 | 0.9 | 0.15 | 0.1 | 0.1 | 0.200 | 0.040 | 0.080 | 4.8 | Bal | 19.5 | 10.0 |
| 4 | Bal | 29.5 | 0.0 | 0.95 | 0.9 | 0.15 | 0.1 | 0.1 | 0.200 | 0.020 | 0.100 | 4.8 | Bal | 19.5 | 10.0 |
| 5 | Bal | 31.2 | 0.0 | 0.95 | 0.9 | 0.15 | 0.1 | 0.1 | 0.200 | 0.030 | 0.090 | 4.6 | Bal | 21.2 | 10.0 |
| 6 | Bal | 31.2 | 0.0 | 0.95 | 0.9 | 0.15 | 0.1 | 0.1 | 0.210 | 0.020 | 0.100 | 4.6 | Bal | 21.2 | 10.0 |
| 7 | Bal | 31.2 | 0.0 | 0.95 | 0.9 | 0.15 | 0.1 | 0.1 | 0.200 | 0.020 | 0.100 | 4.6 | Bal | 21.2 | 10.0 |
| 8 | Bal | 29.5 | 0.0 | 0.95 | 0.9 | 0.15 | 0.1 | 0.1 | 0.220 | 0.050 | 0.070 | 4.4 | Bal | 19.5 | 10.0 |
| 9 | Bal | 29.5 | 0.0 | 0.95 | 0.9 | 0.15 | 0.1 | 0.1 | 0.200 | 0.020 | 0.100 | 4.4 | Bal | 19.5 | 10.0 |
| 10 | Bal | 29.5 | 0.0 | 0.95 | 0.9 | 0.15 | 0.1 | 0.1 | 0.200 | 0.020 | 0.100 | 4.4 | Bal | 19.5 | 10.0 |
| 11 | Bal | 29.5 | 0.0 | 0.95 | 0.9 | 0.15 | 0.1 | 0.1 | 0.180 | 0.040 | 0.080 | 4.4 | Bal | 19.5 | 10.0 |
| 12 | Bal | 28.0 | 0.0 | 0.95 | 0.9 | 0.15 | 0.1 | 0.1 | 0.200 | 0.020 | 0.100 | 4.1 | Bal | 26.0 | 10.0 |
| 13 | Bal | 28.0 | 0.0 | 0.95 | 0.9 | 0.15 | 0.1 | 0.1 | 0.190 | 0.030 | 0.100 | 4.1 | Bal | 26.0 | 10.0 |
| 14 | Bal | 29.2 | 2.0 | 0.95 | 0.9 | 0.15 | 0.1 | 0.1 | 0.200 | 0.020 | 0.100 | 4.6 | Bal | 21.2 | 10.0 |
| 15 | Bal | 29.2 | 2.0 | 0.95 | 0.9 | 0.15 | 0.1 | 0.1 | 0.200 | 0.020 | 0.070 | 4.6 | Bal | 21.2 | 10.0 |
| 16 | Bal | 29.5 | 0.0 | 0.95 | 0.9 | 0.15 | 0.1 | 0.1 | 0.220 | 0.020 | 0.100 | 4.8 | | | |
| 17 | Bal | 27.6 | 1.9 | 0.95 | 0.9 | 0.15 | 0.1 | 0.1 | 0.210 | 0.020 | 0.080 | 4.7 | | | |
| 18 | Bal | 25.5 | 4.0 | 0.95 | 0.9 | 0.15 | 0.1 | 0.1 | 0.200 | 0.020 | 0.100 | 4.5 | | | |
| 19 | Bal | 29.5 | 0 | 0.95 | 0.9 | 0.15 | 0.1 | 0.1 | 0.200 | 0.030 | 0.100 | 4.8 | Bal | 19.5 | 10.0 |
| 20 | Bal | 29.5 | 0 | 0.95 | 0.9 | 0.15 | 0.1 | 0.1 | 0.200 | 0.020 | 0.100 | 4.8 | Bal | 25.5 | 4.0 |
| 21 | Bal | 29.5 | 0 | 0.95 | 0.9 | 0.15 | 0.1 | 0.1 | 0.200 | 0.020 | 0.100 | 4.8 | Bal | 26.5 | 3.0 |
| 22 | Bal | 31.2 | 0.0 | 0.95 | 0.9 | 0.15 | 0.1 | 0.1 | 0.195 | 0.020 | 0.100 | 4.7 | Bal | 21.2 | 10.0 |
| 23 | Bal | 31.2 | 0.0 | 0.95 | 0.9 | 0.15 | 0.1 | 0.1 | 0.398 | 0.020 | 0.100 | 4.7 | Bal | 21.2 | 10.0 |
| 24 | Bal | 31.2 | 0.0 | 0.95 | 0.9 | 0.15 | 0.1 | 0.1 | 0.210 | 0.020 | 0.100 | 4.7 | Bal | 21.2 | 10.0 |
| 25 | Bal | 31.2 | 0.0 | 0.95 | 0.9 | 0.15 | 0.1 | 0.1 | 0.410 | 0.020 | 0.100 | 4.7 | Bal | 21.2 | 10.0 |

TABLE 1-continued

| | R-T-B based alloy powder B | | | | | | | | | mixing | |
|---|---|---|---|---|---|---|---|---|---|---|---|
| | composition (mass %) | | | | | | | | D50 | ratio (%) | |
| No | B | Co | Al | Cu | Ga | O | N | C | (μm) | (A:B) | |
| 1 | 0.95 | 0.9 | 0.15 | 0.1 | 0.1 | 0.200 | 0.050 | 0.100 | 4.6 | 80% | 20% |
| 2 | 0.95 | 0.9 | 0.15 | 0.1 | 0.1 | 0.220 | 0.030 | 0.100 | 3.6 | 80% | 20% |
| 3 | 0.95 | 0.9 | 0.15 | 0.1 | 0.1 | 0.210 | 0.040 | 0.090 | 2.6 | 80% | 20% |
| 4 | 0.95 | 0.9 | 0.15 | 0.1 | 0.1 | 0.048 | 0.020 | 0.250 | 2.8 | 90% | 10% |
| 5 | 0.95 | 0.9 | 0.15 | 0.1 | 0.1 | 0.200 | 0.020 | 0.100 | 4.5 | 80% | 20% |
| 6 | 0.95 | 0.9 | 0.15 | 0.1 | 0.1 | 0.200 | 0.020 | 0.100 | 2.1 | 80% | 20% |
| 7 | 0.95 | 0.9 | 0.15 | 0.1 | 0.1 | 0.050 | 0.020 | 0.260 | 2.1 | 85% | 15% |
| 8 | 0.95 | 0.9 | 0.15 | 0.1 | 0.1 | 0.180 | 0.030 | 0.100 | 2.3 | 95% | 5% |
| 9 | 0.95 | 0.9 | 0.15 | 0.1 | 0.1 | 0.200 | 0.020 | 0.080 | 2.3 | 90% | 10% |
| 10 | 0.95 | 0.9 | 0.15 | 0.1 | 0.1 | 0.190 | 0.040 | 0.100 | 2.3 | 70% | 30% |
| 11 | 0.95 | 0.9 | 0.15 | 0.1 | 0.1 | 0.200 | 0.020 | 0.070 | 2.3 | 55% | 45% |
| 12 | 0.95 | 0.9 | 0.15 | 0.1 | 0.1 | 0.180 | 0.020 | 0.100 | 4.1 | 80% | 20% |
| 13 | 0.95 | 0.9 | 0.15 | 0.1 | 0.1 | 0.210 | 0.020 | 0.100 | 2.4 | 80% | 20% |
| 14 | 0.95 | 0.9 | 0.15 | 0.1 | 0.1 | 0.200 | 0.030 | 0.070 | 4.6 | 75% | 25% |
| 15 | 0.95 | 0.9 | 0.15 | 0.1 | 0.1 | 0.220 | 0.020 | 0.100 | 2.0 | 75% | 25% |
| 16 | | | | | | | | | | 100% | 0% |
| 17 | | | | | | | | | | 100% | 0% |
| 18 | | | | | | | | | | 100% | 0% |
| 19 | 0.95 | 0.9 | 0.15 | 0.1 | 0.1 | 0.200 | 0.020 | 0.100 | 2.6 | 90% | 10% |
| 20 | 0.95 | 0.9 | 0.15 | 0.1 | 0.1 | 0.200 | 0.020 | 0.150 | 2.6 | 75% | 25% |
| 21 | 0.95 | 0.9 | 0.15 | 0.1 | 0.1 | 0.200 | 0.030 | 0.100 | 2.6 | 67% | 33% |
| 22 | 0.95 | 0.9 | 0.15 | 0.1 | 0.1 | 0.210 | 0.020 | 0.100 | 4.4 | 90% | 10% |
| 23 | 0.95 | 0.9 | 0.15 | 0.1 | 0.1 | 0.420 | 0.020 | 0.100 | 4.4 | 90% | 10% |
| 24 | 0.95 | 0.9 | 0.15 | 0.1 | 0.1 | 0.195 | 0.020 | 0.100 | 2.3 | 90% | 10% |
| 25 | 0.95 | 0.9 | 0.15 | 0.1 | 0.1 | 0.390 | 0.020 | 0.100 | 2.3 | 90% | 10% |

In this case, in order to confirm the influence of the pulverization method, beads mill pulverization was carried out on Samples #4 and #7 shown in Table 1 for a predetermined period of time using beads with a diameter of 0.8 mm as media and n-paraffin as a solvent instead of the jet pulverizer. In this manner, an R-T-B based alloy powder B with the target composition and the predetermined D50 particle size was obtained.

Also, as for Samples #16 to #18 shown in Table 1, two R-T-B based alloy powders with two different compositions were not provided but an R-T-B based alloy powder with a single composition was provided.

Those powders A and B were mixed together at any of the mixing ratios shown in Table 1 with an appropriate amount of lubricant added thereto.

Then, the mixed powder thus obtained was compacted under a magnetic field to obtain a compact. In this case, the magnetic field applied was a static magnetic field with a strength of approximately 0.8 MA/m and the pressure was 5 MPa. The magnetic field application direction and the pressuring direction were perpendicular to each other.

Then, the compact thus obtained was sintered at temperature(s) falling within the range of 960° C. to 1020° C. for two hours within a vacuum. The sintering process temperature varied according to the composition. In any case, the compact was sintered at a lowest possible temperature selected as long as the sintered density would be 7.5 $Mg/m^3$.

Thereafter, the sintered magnet thus obtained was machined to obtain a sample of sintered R-T-B based magnet with a thickness of 3 mm, a length of 10 mm and a width of 10 mm.

The sintered magnet thus obtained was thermally treated at various temperatures for an hour within an Ar atmosphere and then cooled. The heat treatment was carried out with the temperature changed according to the composition. Also, on some samples, the heat treatment was conducted three times at mutually different temperatures. As for the magnetic properties, among those samples with various compositions that had been thermally treated under multiple different conditions, only one of the samples that exhibited the highest coercivity $H_{cJ}$ at room temperature was analyzed.

Then, those samples were machined and then had their magnetic properties (i.e., the remanence $B_r$ and coercivity $B_{cJ}$) measured at room temperature by a B-H tracer. Samples that had coercivity $H_{cJ}$ of more than 20 $kO_e$ (i.e., 1592 kA/m) had only their coercivity measured by a pulse excited magnetometer (model TPM produced by Toei Industry Co., Ltd.). It should be noted that the remanence value of a sample reflects the magnitude of magnetization of the sample. The compositions and magnetic properties of the sintered magnets are shown in the following Table 2, in which the crystal grain size is the equivalent circle diameter of the largest one of the crystal grains that were detected when the sintered structure was observed. The present inventors confirmed that no samples had caused abnormal grain growth.

TABLE 2

| | sintered R-T-B based magnet | | | | | | | | | | | | | | |
|---|---|---|---|---|---|---|---|---|---|---|---|---|---|---|---|
| | Composition (mass %) | | | | | | | | | | | crystal grain size | Magnetic properties | | |
| No | Fe | Nd | Dy | B | Co | Al | Cu | Ga | O | N | C | (μm) | $B_r$ (kG) | $H_{cJ}$ (kOe) | $(BH)_{max}$ (MGOe) |
| 1 | Bal | 27.5 | 2.0 | 0.95 | 0.90 | 0.15 | 0.10 | 0.10 | 0.192 | 0.026 | 0.100 | 18 | 14.38 | 14.36 | 49.64 |
| 2 | Bal | 27.5 | 2.0 | 0.95 | 0.90 | 0.15 | 0.10 | 0.10 | 0.204 | 0.022 | 0.100 | 17 | 14.36 | 15.41 | 49.85 |
| 3 | Bal | 27.5 | 2.0 | 0.95 | 0.90 | 0.15 | 0.10 | 0.10 | 0.202 | 0.040 | 0.082 | 18 | 14.35 | 15.97 | 50.00 |
| 4 | Bal | 28.5 | 1.0 | 0.95 | 0.90 | 0.15 | 0.10 | 0.10 | 0.185 | 0.020 | 0.115 | 15 | 14.46 | 15.08 | 50.40 |
| 5 | Bal | 29.2 | 2.0 | 0.95 | 0.90 | 0.15 | 0.10 | 0.10 | 0.200 | 0.028 | 0.092 | 14 | 13.39 | 19.73 | 42.69 |
| 6 | Bal | 29.2 | 2.0 | 0.95 | 0.90 | 0.15 | 0.10 | 0.10 | 0.208 | 0.020 | 0.100 | 15 | 13.55 | 19.38 | 44.53 |
| 7 | Bal | 29.7 | 1.5 | 0.95 | 0.90 | 0.15 | 0.10 | 0.10 | 0.178 | 0.020 | 0.124 | 16 | 13.67 | 18.38 | 44.92 |
| 8 | Bal | 29.0 | 0.5 | 0.95 | 0.90 | 0.15 | 0.10 | 0.10 | 0.218 | 0.049 | 0.072 | 15 | 14.42 | 14.09 | 49.40 |
| 9 | Bal | 28.5 | 1.0 | 0.95 | 0.90 | 0.15 | 0.10 | 0.10 | 0.200 | 0.020 | 0.098 | 15 | 14.40 | 15.04 | 49.85 |
| 10 | Bal | 26.5 | 3.0 | 0.95 | 0.90 | 0.15 | 0.10 | 0.10 | 0.197 | 0.026 | 0.100 | 12 | 13.98 | 18.90 | 48.40 |
| 11 | Bal | 25.0 | 4.5 | 0.95 | 0.90 | 0.15 | 0.10 | 0.10 | 0.189 | 0.031 | 0.076 | 15 | 13.59 | 20.94 | 47.05 |
| 12 | Bal | 27.6 | 2.0 | 0.95 | 0.90 | 0.15 | 0.10 | 0.10 | 0.196 | 0.020 | 0.100 | 17 | 14.31 | 14.94 | 49.07 |
| 13 | Bal | 27.6 | 2.0 | 0.95 | 0.90 | 0.15 | 0.10 | 0.10 | 0.194 | 0.028 | 0.100 | 16 | 14.39 | 15.70 | 49.62 |
| 14 | Bal | 27.2 | 4.0 | 0.95 | 0.90 | 0.15 | 0.10 | 0.10 | 0.200 | 0.023 | 0.093 | 15 | 12.91 | 23.73 | 44.70 |
| 15 | Bal | 27.2 | 4.0 | 0.95 | 0.90 | 0.15 | 0.10 | 0.10 | 0.205 | 0.020 | 0.078 | 15 | 13.07 | 23.38 | 42.95 |
| 16 | Bal | 29.5 | 0.0 | 0.95 | 0.90 | 0.15 | 0.10 | 0.10 | 0.220 | 0.020 | 0.100 | 11 | 14.71 | 11.66 | 50.43 |
| 17 | Bal | 27.6 | 1.9 | 0.95 | 0.90 | 0.15 | 0.10 | 0.10 | 0.210 | 0.020 | 0.080 | 15 | 14.40 | 14.20 | 49.55 |
| 18 | Bal | 25.5 | 4.0 | 0.95 | 0.90 | 0.15 | 0.10 | 0.10 | 0.200 | 0.020 | 0.100 | 13 | 13.94 | 18.00 | 48.27 |
| 19 | Bal | 28.5 | 1.0 | 0.95 | 0.90 | 0.15 | 0.10 | 0.10 | 0.200 | 0.029 | 0.100 | 15 | 14.45 | 14.66 | 49.89 |
| 20 | Bal | 28.5 | 1.0 | 0.95 | 0.90 | 0.15 | 0.10 | 0.10 | 0.200 | 0.020 | 0.113 | 15 | 14.41 | 15.08 | 49.86 |
| 21 | Bal | 28.5 | 1.0 | 0.95 | 0.90 | 0.15 | 0.10 | 0.10 | 0.200 | 0.023 | 0.100 | 15 | 14.35 | 14.30 | 48.22 |
| 22 | Bal | 30.2 | 1.0 | 0.95 | 0.90 | 0.15 | 0.10 | 0.10 | 0.197 | 0.020 | 0.100 | 15 | 13.84 | 16.11 | 44.68 |
| 23 | Bal | 30.2 | 1.0 | 0.95 | 0.90 | 0.15 | 0.10 | 0.10 | 0.400 | 0.020 | 0.100 | 15 | 13.83 | 15.60 | 43.74 |
| 24 | Bal | 30.2 | 1.0 | 0.95 | 0.90 | 0.15 | 0.10 | 0.10 | 0.209 | 0.020 | 0.100 | 15 | 14.01 | 16.02 | 48.51 |
| 25 | Bal | 30.2 | 1.0 | 0.95 | 0.90 | 0.15 | 0.10 | 0.10 | 0.408 | 0.020 | 0.100 | 15 | 13.99 | 15.41 | 47.03 |

The values representing magnetic properties in Table 2 are converted into SI unit values and shown in the following Table 3:

TABLE 3

| | Magnetic properties (SI) | | |
|---|---|---|---|
| No. | $B_r$ (T) | $H_{cJ}$ (kA/m) | $(BH)_{max}$ (kJ/m$^3$) |
| 1 | 1.438 | 1143 | 395.0 |
| 2 | 1.436 | 1226 | 396.7 |
| 3 | 1.435 | 1271 | 397.9 |
| 4 | 1.446 | 1200 | 401.1 |
| 5 | 1.339 | 1570 | 339.7 |
| 6 | 1.355 | 1543 | 354.4 |
| 7 | 1.367 | 1463 | 357.5 |
| 8 | 1.442 | 1121 | 393.1 |
| 9 | 1.440 | 1197 | 396.7 |
| 10 | 1.398 | 1504 | 385.2 |
| 11 | 1.359 | 1666 | 374.4 |
| 12 | 1.431 | 1189 | 390.5 |
| 13 | 1.439 | 1249 | 394.9 |
| 14 | 1.291 | 1888 | 355.7 |
| 15 | 1.307 | 1861 | 341.8 |
| 16 | 1.471 | 928 | 401.3 |
| 17 | 1.440 | 1130 | 394.3 |
| 18 | 1.394 | 1432 | 384.1 |
| 19 | 1.445 | 1166 | 397.0 |
| 20 | 1.441 | 1200 | 396.8 |
| 21 | 1.435 | 1138 | 383.7 |
| 22 | 1.384 | 1282 | 355.6 |
| 23 | 1.383 | 1241 | 348.1 |
| 24 | 1.401 | 1275 | 386.0 |
| 25 | 1.399 | 1226 | 374.3 |

Comparing the magnetic properties of Samples falling within the range of the present invention to those of the other Samples falling outside of the range of the present invention, it can be seen that the remanence $B_r$ hardly decreased and the coercivity $H_{cJ}$ increased significantly in Samples #2 to #4, #6, #7, #9, #10, #13, #15, #19 to #21, #24 and #25 falling within the range of the present invention. The same effect was confirmed even in Samples #4 and #7, in which the alloy powder B was obtained by performing a wet pulverization process using a beads mill. That is to say, no influence of the pulverization method was confirmed.

Figure 3:
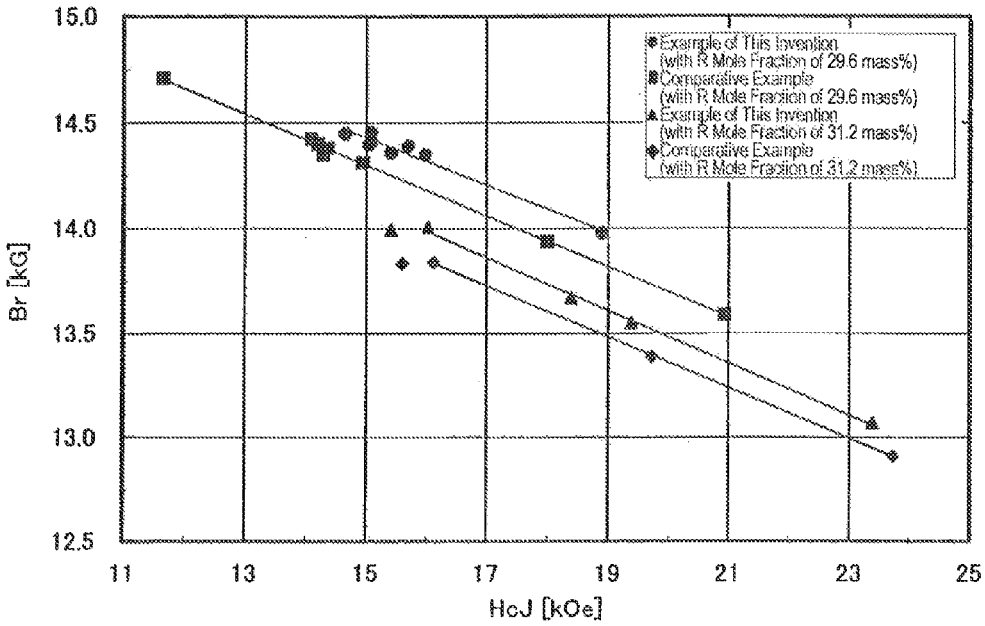
FIG. 3 is a graph, which shows how the property values shown in Table 2 vary and of which the ordinate and abscissa represent the remanence $B_r$ and the coercivity $H_{cJ}$, respectively.
Figure 4:
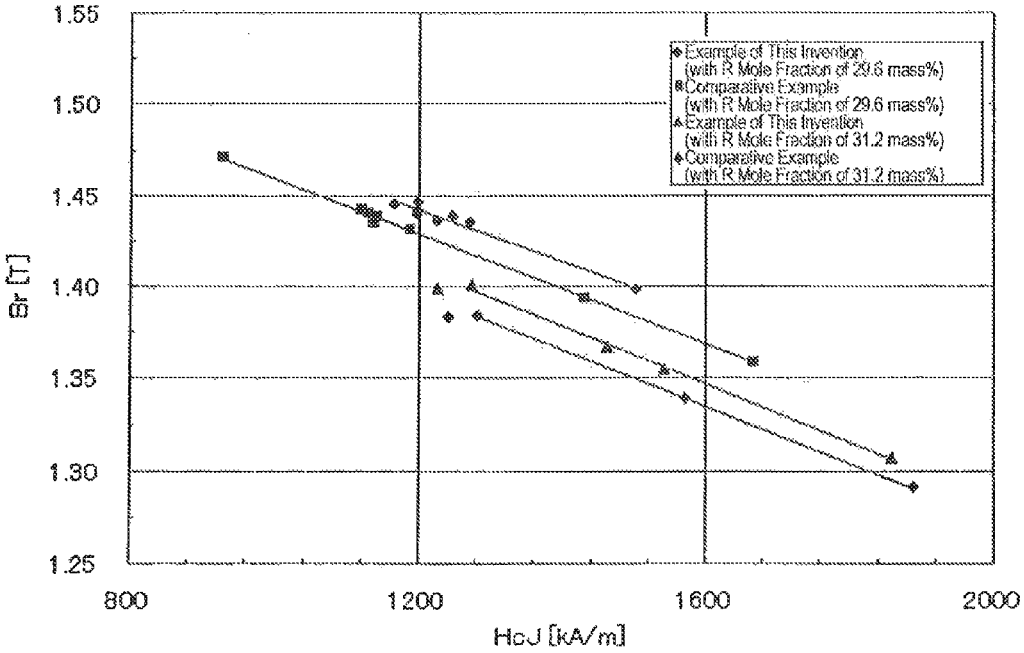
FIG. 4 is a graph plotted by converting the units shown in FIG. 3 into SI units.

The property values shown in Table 2 are plotted as a graph in FIG. 3, of which the ordinate represents the remanence $B_r$ and the abscissa represents the coercivity $H_{cJ}$. In FIG. 3, two sintered magnets, of which the compositions fall within the range of the present invention, the overall R mole fractions of rare-earth elements are the same, but the R element itself accounts for 29.6 mass % and 31.2 mass %, respectively, have their properties shown as two specific examples of the present invention. Also, two more sintered magnets, of which the compositions fall out of the range of the present invention, the overall R mole fractions of rare-earth elements are the same, but the R element itself accounts for 29.6 mass % and 31.2 mass %, respectively, have their properties shown separately as two comparative examples. FIG. 4 is a graph showing their properties by replacing the unit of FIG. 3 with an SI unit.

It can also be seen from FIGS. 3 and 4 that if a magnet with a composition falling within the range of the present invention and a magnet with a composition falling out of the range of the present invention have the same coercivity, the former magnet would cause a less significant decrease in remanence $B_r$ than the latter. And it can also be seen that the coercivity $H_{cJ}$ of the former magnet was higher than that of the latter.

Figure 5:
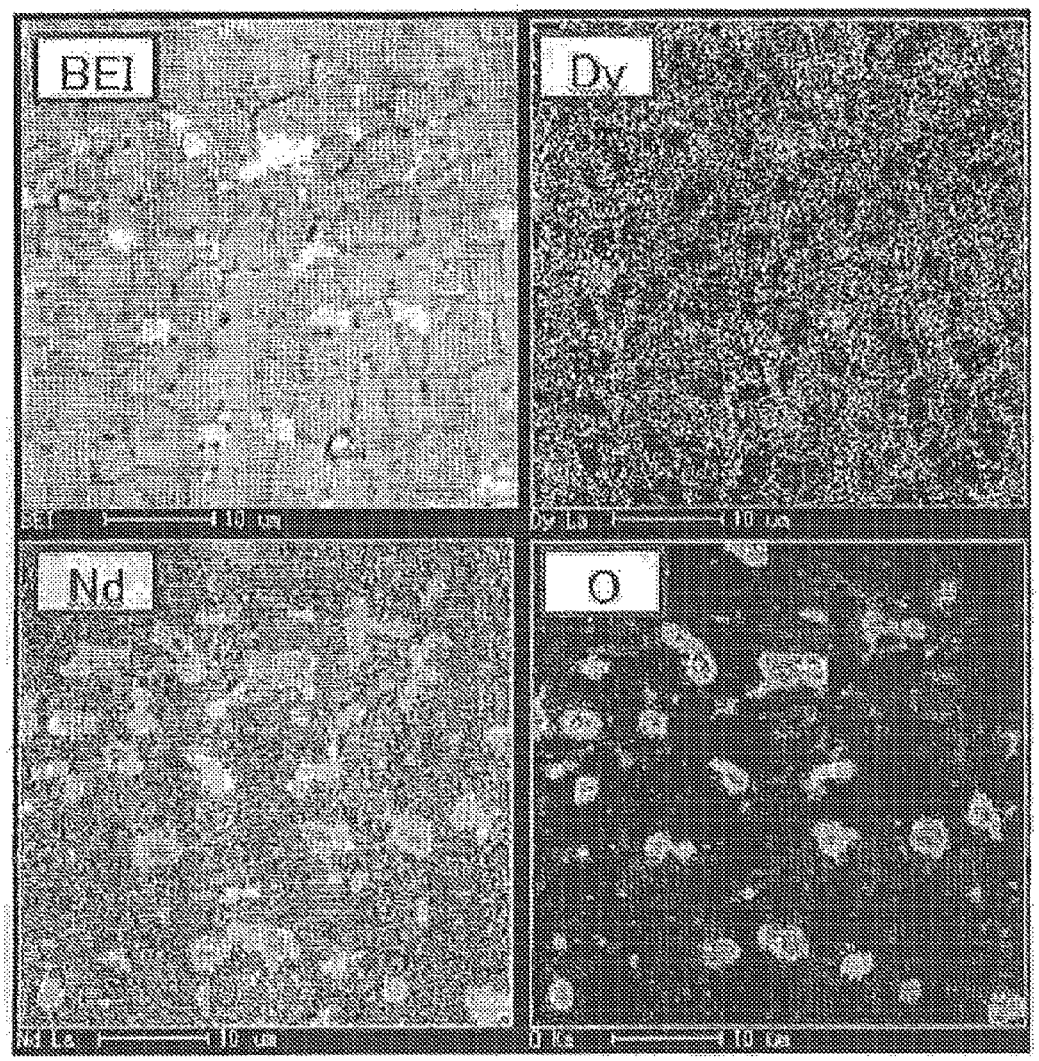
FIG. 5 shows photographs (backscattered electron images) showing a cross-sectional structure of a sintered magnet produced by a sintered R-T-B based magnet manufacturing process according to the present invention.

Cross sections of Samples #1 and #3 were shot with an EPMA (EPM-1610 produced by Shimadzu Corporation). Photographs shown in FIG. 5 were obtained by shooting Sample #3, of which the R-T-B based alloy powders A and B had a crystal grain size difference of 1.0 μm or more. As can be seen from FIG. 5, if two material alloy powders with two different compositions, including a heavy rare-earth element RH in mutually different concentrations, are sintered so that the alloy with the higher RH concentration has the smaller powder particle size, and therefore the higher surface energy, than the other alloy, then the alloy powder with the higher RH concentration turns into a liquid phase earlier with the other alloy powder with the lower RH concentration maintained in solid phase during the sintering process. Since the liquid phase RH concentration can be increased in this manner, the sintered magnet will be made up of crystal grains that have grown so that the R-T-B based alloy powder with the smaller particle size is introduced into the shell portion of the R-T-B based alloy powder with the larger particle size. As a result, just like the main phase crystal grains 5 shown in FIGS. 1(*a*) and 1(*b*) in which a portion 3 where the heavy rare-earth element RH accounts for a low percentage of its rare-earth element R is coated with a portion 4 where the heavy rare-earth element RH accounts for a high percentage of its rare-earth element R, the heavy rare-earth element RH will be included in the higher concentration in part or all of the shell portion of each main grain crystal grain.

Figure 2:
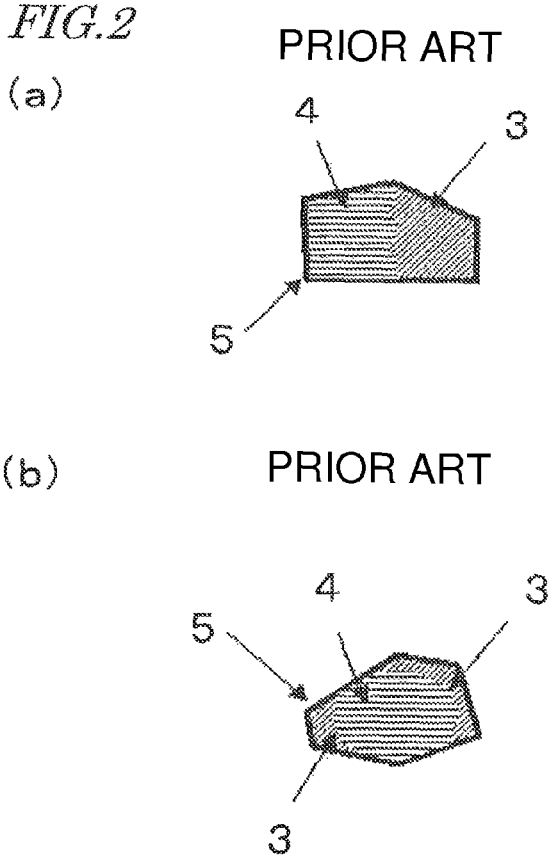
FIGS. 2(*a*) and 2(*b*) are schematic representations illustrating sintered crystal grains, which are obtained by a conventional sintered R-T-B based magnet manufacturing process.
Figure 6:
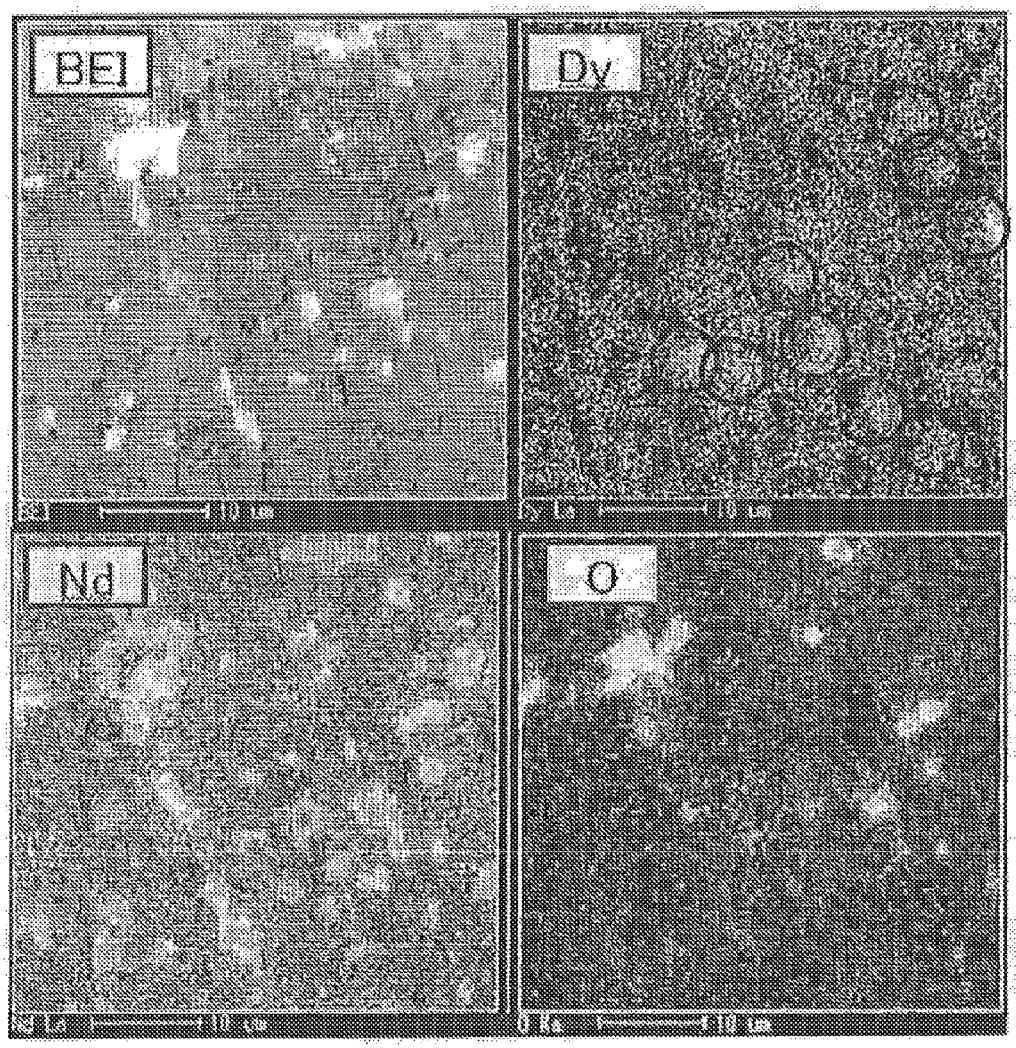
FIG.6 PRIOR ART
FIG. 6 shows photographs (backscattered electron images) showing a cross-sectional structure of a sintered magnet produced by a conventional sintered R-T-B based magnet manufacturing process.

On the other hand, FIG. 6 shows photographs that were obtained by shooting Sample #1, of which the R-T-B based alloy powders A and B had the same crystal grain size. As can be seen from FIG. 6, since the two powders including the heavy rare-earth element RH in relatively low and relatively high concentrations, respectively, have almost no different particle size distributions, crystal grains do not grow so that the R-T-B based alloy powder with the higher heavy rare-earth element RH concentration is introduced into the shell portion of the R-T-B based alloy powder with the lower heavy rare-earth element RH concentration. As encircled in FIG. 6, the sintered magnet had main phase crystal grains 5, one half of which was a portion 3 where the heavy rare-earth element RH accounted for a low percentage of its rare-earth element R and the other half of which was a portion 4 where the heavy rare-earth element RH accounted for a high percentage of its rare-earth element R, as shown in FIG. 2(*a*). Meanwhile, main phase crystal grains 5, in which the portion 4 where the heavy rare-earth element RH accounted for a high percentage of its rare-earth element R was coated with the portion 3 where the heavy rare-earth element RH accounted for a low percentage of its rare-earth element R, were also detected as shown in FIG. 2(*b*). The sintered structures of the sintered magnets, representing Samples #1 through #25 in Table 2, were observed. As a result, their average crystal grain size was comparable to an equivalent circle diameter of 3.5 to 5.5 μm.

Example 2

R-T-B based alloy powders A and B, having the compositions and particle sizes D50 shown in the following Table 4, were obtained by dry pulverization process as in Example 1 described above.

The details are shown in the following Table 4. The analysis was carried out by inductively coupled plasma atomic emission spectroscopy (ICP-AES). The contents of oxygen, nitrogen and carbon were obtained as analyzed values by a gas analyzer.

TABLE 4

| | R-T-B based alloy powder A | | | | | | | | | | | | R-T-B based alloy powder B | | | | | |
|---|---|---|---|---|---|---|---|---|---|---|---|---|---|---|---|---|---|---|
| | composition (mass %) | | | | | | | | | | | D50 | composition (mass %) | | | | | |
| No | Fe | Nd | Dy | B | Co | Al | Cu | Ga | O | N | C | (μm) | Fe | Nd | Dy | B | Co | Al |
| 26 | Bal | 29.5 | 0.0 | 0.95 | 0.9 | 0.15 | 0.1 | 0.1 | 0.11 | 0.02 | 0.10 | 5.9 | Bal | 19.5 | 10.0 | 0.95 | 0.9 | 0.15 |
| 27 | Bal | 29.5 | 0.0 | 0.95 | 0.9 | 0.15 | 0.1 | 0.1 | 0.10 | 0.03 | 0.10 | 5.9 | Bal | 19.5 | 10.0 | 0.95 | 0.9 | 0.15 |
| 28 | Bat | 29.5 | 0.0 | 0.95 | 0.9 | 0.15 | 0.1 | 0.1 | 0.10 | 0.02 | 0.10 | 4.8 | Bal | 19.5 | 10.0 | 0.95 | 0.9 | 0.15 |
| 29 | Bal | 29.5 | 0.0 | 0.95 | 0.9 | 0.15 | 0.1 | 0.1 | 0.10 | 0.02 | 0.10 | 4.8 | Bal | 19.5 | 10.0 | 0.95 | 0.9 | 0.15 |
| 30 | Bal | 29.5 | 0.0 | 0.95 | 0.9 | 0.15 | 0.1 | 0.1 | 0.09 | 0.02 | 0.10 | 4.8 | Bal | 19.5 | 10.0 | 0.95 | 0.9 | 0.15 |
| 31 | Bal | 29.5 | 0.0 | 0.95 | 0.9 | 0.15 | 0.1 | 0.1 | 0.10 | 0.03 | 0.10 | 5.9 | | | | | | |
| 32 | Bal | 27.5 | 2.0 | 0.95 | 0.9 | 0.15 | 0.1 | 0.1 | 0.12 | 0.02 | 0.10 | 5.9 | | | | | | |
| 33 | Bal | 27.5 | 2.0 | 0.95 | 0.9 | 0.15 | 0.1 | 0.1 | 0.10 | 0.02 | 0.10 | 5.9 | Bal | 27.5 | 2.0 | 0.95 | 0.9 | 0.15 |
| 34 | Bal | 27.5 | 2.0 | 0.95 | 0.9 | 0.15 | 0.1 | 0.1 | 0.09 | 0.03 | 0.10 | 5.9 | Bal | 27.5 | 2.0 | 0.95 | 0.9 | 0.15 |
| 35 | Bal | 29.5 | 0.0 | 0.95 | 0.9 | 0.15 | 0.1 | 0.1 | 0.10 | 0.03 | 0.10 | 4.7 | | | | | | |
| 36 | Bal | 27.5 | 2.0 | 0.95 | 0.9 | 0.15 | 0.1 | 0.1 | 0.12 | 0.02 | 0.10 | 4.5 | | | | | | |
| 37 | Bal | 31.0 | 0.0 | 0.98 | 0 | 0.05 | 0 | 0 | 0.41 | 0.02 | 0.10 | 4.9 | Bal | 21.0 | 10.0 | 0.98 | 0 | 0.05 |
| 38 | Bal | 31.0 | 0.0 | 0.98 | 0 | 0.05 | 0 | 0 | 0.40 | 0.03 | 0.10 | 4.9 | Bal | 21.0 | 10.0 | 0.98 | 0 | 0.05 |

| | R-T-B based alloy powder B | | | | | | difference in D50 particle size (μm) be- | mixing | | sintering process |
|---|---|---|---|---|---|---|---|---|---|---|
| | composition (mass %) | | | | | D50 | tween powders | ratio (%) | | temperature |
| No | Cu | Ga | O | N | C | (μm) | A and B | (A:B) | | [° C.] |
| 26 | 0.1 | 0.1 | 0.10 | 0.02 | 0.10 | 5.9 | 0 | 80% | 20% | 1005 |
| 27 | 0.1 | 0.1 | 0.11 | 0.03 | 0.11 | 2.8 | 3.1 | 80% | 20% | 1000 |
| 28 | 0.1 | 0.1 | 0.12 | 0.02 | 0.11 | 4.7 | 0.1 | 80% | 20% | 1000 |
| 29 | 0.1 | 0.1 | 0.09 | 0.02 | 0.10 | 2.9 | 1.9 | 80% | 20% | 990 |
| 30 | 0.1 | 0.1 | 0.11 | 0.03 | 0.11 | 2.2 | 2.6 | 80% | 20% | 980 |
| 31 | | | | | | | — | 100% | 0% | 1010 |
| 32 | | | | | | | — | 100% | 0% | 1010 |
| 33 | 0.1 | 0.1 | 0.10 | 0.02 | 0.10 | 4.5 | 1.4 | 80% | 20% | 1005 |
| 34 | 0.1 | 0.1 | 0.11 | 0.02 | 0.12 | 2.9 | 3 | 80% | 20% | 1005 |
| 35 | | | | | | | — | 100% | 0% | 1005 |
| 36 | | | | | | | — | 100% | 0% | 1005 |
| 37 | 0 | 0 | 0.40 | 0.02 | 0.10 | 4.8 | 0.1 | 80% | 20% | 1020 |
| 38 | 0 | 0 | 0.42 | 0.03 | 0.10 | 2.4 | 2.5 | 80% | 20% | 1010 |

Also, as for Samples #31, #32, #35 and #36 shown in Table 4, two R-T-B based alloy powders with two different compositions were not provided but an R-T-B based alloy powder with a single composition was provided.

Those powders A and B were mixed together at any of the mixing ratios shown in Table 4 with an appropriate amount of lubricant added thereto.

Then, the mixed powder thus obtained was processed on the same manufacturing process conditions as the one adopted in Example 1 described above to obtain a sample of sintered R-T-B based magnet with a thickness of 3 mm, a length of 10 mm and a width of 10 mm. The sintering process temperatures of Samples #26 through #38 are also shown in Table 4.

The sintered magnet thus obtained was thermally treated at various temperatures for an hour within an Ar atmosphere and then cooled as in Example 1 described above. Then, those samples had their magnetic properties measured. The results are shown in Table 5, in which the crystal grain size is the equivalent circle diameter of the largest one of the crystal grains that were detected when the sintered structure was observed. The present inventors confirmed that no samples had caused abnormal grain growth.

TABLE 5

| | sintered R-T-B based magnet | | | | | | | | | | | | | | |
|---|---|---|---|---|---|---|---|---|---|---|---|---|---|---|---|
| | Composition (mass %) | | | | | | | | | | | crystal grain size | Magnetic properties | | |
| No | Fe | Nd | Dy | B | Co | Al | Cu | Ga | O | N | C | (μm) | $B_r$ (kG) | $H_{cJ}$ (kOe) | $(BH)_{max}$ (MGOe) |
| 26 | Bal | 27.5 | 2.0 | 0.95 | 0.90 | 0.15 | 0.10 | 0.10 | 0.108 | 0.020 | 0.100 | 20 | 14.30 | 16.26 | 49.13 |
| 27 | Bal | 27.5 | 2.0 | 0.95 | 0.90 | 0.15 | 0.10 | 0.10 | 0.102 | 0.030 | 0.102 | 20 | 14.32 | 16.84 | 49.74 |
| 28 | Bal | 27.5 | 2.0 | 0.95 | 0.90 | 0.15 | 0.10 | 0.10 | 0.104 | 0.020 | 0.102 | 15 | 14.26 | 16.96 | 48.83 |
| 29 | Bal | 27.5 | 2.0 | 0.95 | 0.90 | 0.15 | 0.10 | 0.10 | 0.098 | 0.020 | 0.100 | 13 | 14.33 | 17.85 | 49.42 |
| 30 | Bal | 27.5 | 2.0 | 0.95 | 0.90 | 0.15 | 0.10 | 0.10 | 0.094 | 0.022 | 0.102 | 13 | 14.35 | 18.00 | 49.50 |
| 31 | Bal | 29.5 | 0.0 | 0.95 | 0.90 | 0.15 | 0.10 | 0.10 | 0.100 | 0.030 | 0.100 | 20 | 14.66 | 11.82 | 50.94 |
| 32 | Bal | 27.5 | 2.0 | 0.95 | 0.90 | 0.15 | 0.10 | 0.10 | 0.120 | 0.020 | 0.100 | 20 | 14.14 | 16.20 | 47.83 |
| 33 | Bal | 27.5 | 2.0 | 0.95 | 0.90 | 0.15 | 0.10 | 0.10 | 0.100 | 0.020 | 0.100 | 20 | 14.13 | 16.11 | 47.73 |
| 34 | Bal | 27.5 | 2.0 | 0.95 | 0.90 | 0.15 | 0.10 | 0.10 | 0.094 | 0.028 | 0.104 | 20 | 14.11 | 16.28 | 47.55 |
| 35 | Bal | 29.5 | 0.0 | 0.95 | 0.90 | 0.15 | 0.10 | 0.10 | 0.100 | 0.030 | 0.100 | 15 | 14.67 | 12.59 | 50.96 |
| 36 | Bal | 27.5 | 2.0 | 0.95 | 0.90 | 0.15 | 0.10 | 0.10 | 0.120 | 0.020 | 0.100 | 15 | 14.14 | 16.93 | 47.87 |
| 37 | Bal | 29.0 | 2.0 | 0.98 | 0.90 | 0.05 | 0.00 | 0.00 | 0.408 | 0.020 | 0.100 | 16 | 13.70 | 8.64 | 46.39 |
| 38 | Bal | 29.0 | 2.0 | 0.98 | 0.90 | 0.05 | 0.00 | 0.00 | 0.404 | 0.030 | 0.100 | 15 | 13.73 | 9.60 | 46.71 |

The values representing magnetic properties in Table 5 are converted into SI unit values and shown in the following Table 6:

TABLE 6

| | Magnetic properties (SI) | | |
|---|---|---|---|
| No. | $B_r$ (T) | $H_{cJ}$ (kA/m) | $(BH)_{max}$ (kJ/m$^3$) |
| 26 | 1.430 | 1294 | 391.0 |
| 27 | 1.432 | 1340 | 395.8 |
| 28 | 1.426 | 1350 | 388.6 |
| 29 | 1.433 | 1420 | 393.3 |
| 30 | 1.435 | 1432 | 393.9 |
| 31 | 1.466 | 941 | 405.4 |
| 32 | 1.414 | 1289 | 380.6 |
| 33 | 1.413 | 1282 | 379.8 |
| 34 | 1.411 | 1296 | 378.4 |
| 35 | 1.467 | 1002 | 405.5 |
| 36 | 1.414 | 1347 | 380.9 |

TABLE 6-continued

| | Magnetic properties (SI) | | |
|---|---|---|---|
| No. | $B_r$ (T) | $H_{cJ}$ (kA/m) | $(BH)_{max}$ (kJ/m$^3$) |
| 37 | 1.370 | 688 | 369.2 |
| 38 | 1.373 | 764 | 371.7 |

Comparing the magnetic properties of Samples #26, #27 and #32 to each other among Samples #26 through #38 shown in Tables 5 and 6, it can be seen that Sample #27 falling within the range of the present invention had greater remanence $B_r$ and greater coercivity $H_{cJ}$ than Samples #26 and #32 falling outside of the range of the present invention.

It can also be seen that Samples #29 and #30, representing specific examples of the present invention, had greatest coercivities $H_{cJ}$ among other samples of the present invention. This should be because by going through the sintering process at a temperature of less than 1000° C., the R-T-B based alloy powder having the smaller particle size and the higher heavy rare-earth element RH concentration would have turned into a liquid phase once, had its concentration increased, and then re-deposited on the shell portion of the R-T-B based alloy powder having the larger particle size and the lower heavy rare-earth element RH concentration. Furthermore, the present inventors also confirmed that the sintered structures of Samples #26 through #38 had an average crystal grain size of 3 to 6 μm and that the magnet of the present invention had a similar crystal grain size distribution to a conventional one. Consequently, it should be not so much the size of crystal grains as the distribution of a heavy rare-earth element in crystal grains that contributed to producing the effect of the present invention.

Example 3

R-T-B based alloy powders A and B, having the compositions and particle sizes D50 shown in the following Table 7, were obtained by dry pulverization process as in Example 1 described above.

The details are shown in the following Table 7. The analysis was carried out by inductively coupled plasma atomic emission spectroscopy (ICP-AES). The contents of oxygen, nitrogen and carbon were obtained as analyzed values by a gas analyzer.

TABLE 7

| | R-T-B based alloy powder A | | | | | | | | | | | | R-T-B based alloy powder B | | | | | | | | |
|---|---|---|---|---|---|---|---|---|---|---|---|---|---|---|---|---|---|---|---|---|---|
| | Composition (mass %) | | | | | | | | | | | D50 | Composition (mass %) | | | | | | | | |
| No | Fe | Nd | Dy | B | Co | Al | Cu | Ga | O | N | C | (μm) | Fe | Nd | Dy | B | Co | Al | Cu | Ga | O |
| 39 | Bal | 28.4 | 0.0 | 0.9 | 1.9 | 0.11 | 0.1 | 0.1 | 0.059 | 0.034 | 0.058 | 4.0 | Bal | 20.0 | 10.0 | 0.94 | 2.0 | 0.10 | 0.1 | 0.1 | 0.097 |
| 40 | Bal | 28.4 | 0.0 | 0.9 | 1.9 | 0.11 | 0.1 | 0.1 | 0.059 | 0.034 | 0.058 | 4.0 | Bal | 20.0 | 10.0 | 0.94 | 2.0 | 0.10 | 0.1 | 0.1 | 0.070 |
| 41 | Bal | 28.4 | 0.0 | 0.9 | 1.9 | 0.11 | 0.1 | 0.1 | 0.059 | 0.034 | 0.058 | 4.0 | Bal | 20.0 | 10.0 | 0.94 | 2.0 | 0.10 | 0.1 | 0.1 | 0.075 |

Those powders A and B were mixed together at any of the mixing ratios shown in Table 7 with 0.4 mass % of methyl caprylate added as a lubricant to the powders being mixed.

Then, the mixed powder thus obtained was processed on the same manufacturing process conditions as the one adopted in Example 1 described above to obtain a sample of sintered R-T-B based magnet with a thickness of 3 mm, a length of 10 mm and a width of 10 mm. The sintering process temperatures of Samples #39 through #41 are also shown in Table 7.

The sintered magnet thus obtained was thermally treated at various temperatures for an hour within an Ar atmosphere and then cooled as in Example 1 described above. The results are shown in the following Table 8, in which the magnetic properties on the upper row were measured at 23° C., while the magnetic properties in italics on the lower row were measured at 140° C.

#39, representing a specific example of the present invention, to be 1035° C., an abnormal grain growth was observed in the sintered structure and the maximum crystal grain size reached 35 μm or even more. The sintered R-T-B based magnet, which was made by changing the sintering process temperature of Sample #39 representing a specific example of the present invention into 1035° C., had decreased degree of loop squareness in its demagnetization curve and came to have significantly decreased remanence $B_r$ and coercivity $H_{cJ}$.

Figure 7:
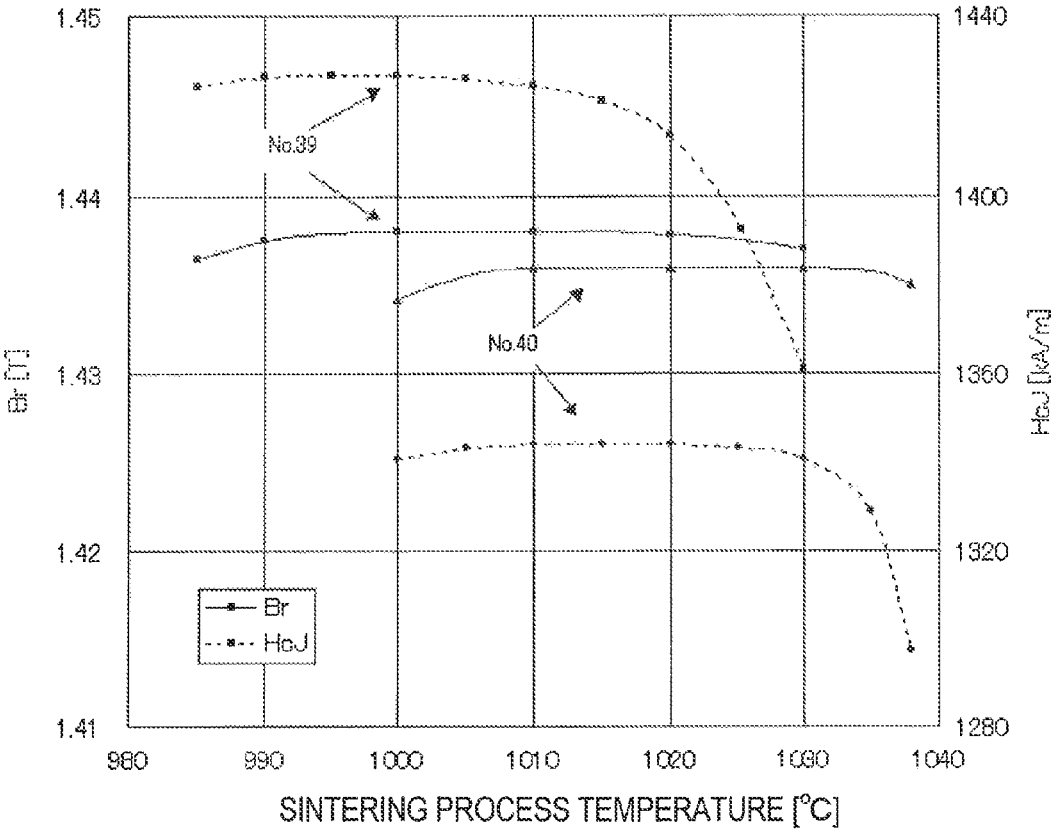
FIG. 7 is a graph showing how the magnetic properties (that are remanence $B_r$ and coercivity $H_{cJ}$) change with the sintering process temperature according to the present invention.

Furthermore, as for Sample #39 representing a specific example of the present invention and Sample #40 representing a comparative example, the present inventors carried out experiments to find how their magnetic properties would vary if the sintering process temperature was changed within the range of 985° C. to 1040° C. The results are shown in FIG. 7, of which the ordinates on the left- and right-hand sides represent the remanence $B_r$ and the coercivity $H_{cJ}$, respectively.

TABLE 8

| | R-T-B based sintered magnet | | | | | | | | | | | | | | | | | |
|---|---|---|---|---|---|---|---|---|---|---|---|---|---|---|---|---|---|---|
| | Composition (mass %) | | | | | | | | | | | Crystal grain size (μm) | | Magnetic properties | | | Sintering process temp. |
| | | | | | | | | | | | | | | $B_r$ | $H_{cJ}$ | $(BH)_{max}$ | |
| No | Fe | Nd | Dy | B | Co | Al | Cu | Ga | O | N | C | Max. | Av. | (T) | (kA/m) | (kJ/m$^3$) | (° C.) |
| 39 | Bal | 26.3 | 2.5 | 0.94 | 1.93 | 0.11 | 0.08 | 0.10 | 0.075 | 0.037 | 0.075 | 11.9 | 4.2 | 1.438 | 1427 | 399.2 | 1000 |
| | | | | | | | | | | | | | | *1.282* | *501* | *288.1* | |
| 40 | Bal | 26.3 | 2.5 | 0.94 | 1.93 | 0.11 | 0.08 | 0.10 | 0.067 | 0.035 | 0.065 | 12.8 | 4.4 | 1.436 | 1344 | 398.3 | 1010 |
| | | | | | | | | | | | | | | *1.280* | *470* | *287.4* | |
| 41 | Bal | 25.9 | 3.0 | 0.94 | 1.93 | 0.11 | 0.08 | 0.10 | 0.069 | 0.036 | 0.066 | 13.2 | 4.9 | 1.424 | 1416 | 395.3 | 1015 |
| | | | | | | | | | | | | | | *1.248* | *483* | *284.8* | |

Comparing the results of Samples #39 and #40 to each other among the Samples #39, #40 and #41 shown in Tables 7 and 8, it can be seen that there are no significant differences between them as far as the maximum and average crystal grain sizes of the sintered magnets are concerned. Thus, it can be seen that the $H_{cJ}$ increasing effect of the present invention is achieved due to a difference in particle size between the two material alloy powders, rather than by decreasing the feature size of the structure. On the other hand, comparing the results of Sample #39 to those of Sample #41, having the higher Dy concentration, their coercivities $H_{cJ}$ are approximately equal to each other, no matter whether it is room temperature or elevated temperature. Thus, it can be seen that the increase in coercivity $H_{cJ}$ achieved by the present invention is still effective even at high temperatures.

Also, when a sintered R-T-B based magnet was made by setting the sintering process temperature of Sample #39, representing a specific example of the present invention, to 1020° C., no abnormal grain growth was observed in the sintered structure. However, when a sintered R-T-B based magnet was made by setting the sintering process temperature of Sample As can be seen from FIG. 7, the present inventors confirmed that even if Sample #39 representing a specific example of the present invention was sintered at a temperature of 1030 ° C. or less, at which crystal grains would never grow abnormally, the coercivity increased less steeply as the sintering process temperature rose. This should be because the higher the temperature, the more uniform the distribution of Dy in the sintered magnet. Consequently, the effect of the present invention would be produced more significantly when the sintering process is carried out at a low temperature.

That is why according to the present invention, as long as the sintering process temperature is adequate enough to obtain a sintered body with sufficient density, it is preferred that the sintering process be carried out at as low a temperature as possible. Nevertheless, it is not that no effects will be achieved unless the sintering temperature is low. According to the data shown in FIG. 7, the lowest coercivity $H_{cJ}$ was achieved at a sintering process temperature of 1030° C. However, that coercivity is still higher than the coercivity $H_{cJ}$ values of Samples #40 and #41 representing comparative examples in Tables 7 and 8. Consequently, it can be seen that even if the sintering process temperature is as low as about 1030° C., sufficiently high coercivity can be achieved according to the present invention.

Industrial Applicability

The sintered R-T-B based magnet of the present invention is a sintered rare-earth magnet that has had its coercivity $H_{cJ}$ increased significantly almost without decreasing its remanence $B_r$.

Reference Signs List

1 $R_2T_{14}B$ based alloy powder in which heavy rare-earth element RH accounts for relatively low percentage of rare-earth element R

2 $R_2T_{14}B$ based alloy powder in which heavy rare-earth element RH accounts for relatively high percentage of rare-earth element R

3 portion in which heavy rare-earth element RH accounts for relatively low percentage of rare-earth element R

4 portion in which heavy rare-earth element RH accounts for relatively high percentage of rare-earth element R

5 main phase crystal grain of sintered R-T-B based magnet

The invention claimed is:

1. A method for producing a sintered R-T-B based magnet, the method comprising the steps of:

providing R-T-B based alloy powders A and B, wherein the powder A includes 27.3 mass % to 31.2 mass % of R (which is at least one of the rare-earth elements), 0.92 mass % to 1.15 mass % of B, and T as the balance (where T is either Fe alone or Fe and Co and where Co accounts for at most 20 mass % of T if T includes Fe and Co) and wherein the powder B includes 27.3 mass % to 36.0 mass % of R (which is at least one of the rare-earth elements), 0.92 mass % to 1.15 mass % of B, and T as the balance (where T is either Fe alone or Fe and Co and where Co accounts for at most 20 mass % of T if T includes Fe and Co);

mixing these two R-T-B based alloy powders A and B together;

compacting the mixed R-T-B based alloy powder to obtain a compact with a predetermined shape; and sintering the compact, wherein R included in the R-T-B based alloy powder B includes 4 mass % to 36 mass % of heavy rare-earth element RH, which is at least one of Dy and Tb, and wherein the content of the heavy rare-earth element RH in the R-T-B based alloy powder B is larger by at least 4 mass % than the content of the heavy rare-earth element RH in the R-T-B based alloy powder A, and wherein the particle size D50 of the R-T-B based alloy powder B is smaller by at least 1.0 μm than the particle size D50 of the R-T-B based alloy powder A.

2. The method of claim 1, wherein in the step of mixing, the R-T-B based alloy powder A has a particle size D50 of 3 to 6 μm.

3. The method of claim 1, wherein in the step of mixing, the R-T-B based alloy powder B has a particle size D50 of 1.5 to 3 μm.

4. The method of claim 1, wherein in the step of mixing the R-T-B based alloy powders A and B together, the ratio of the mass of the R-T-B based alloy powder A to the mass of the R-T-B based alloy powder B is controlled to fall within the range of 60:40 to 90:10.

5. The method of claim 2, wherein in the step of mixing the R-T-B based alloy powders A and B together, the ratio of the mass of the R-T-B based alloy powder A to the mass of the R-T-B based alloy powder B is controlled to fall within the range of 60:40 to 90:10.

6. The method of claim 3, wherein in the step of mixing the R-T-B based alloy powders A and B together, the ratio of the mass of the R-T-B based alloy powder A to the mass of the R-T-B based alloy powder B is controlled to fall within the range of 60:40 to 90:10.

* * * * *